US010295282B2

(12) United States Patent
Powell et al.

(10) Patent No.: US 10,295,282 B2
(45) Date of Patent: May 21, 2019

(54) HEAT EXCHANGER WITH FLOW OBSTRUCTIONS TO REDUCE FLUID DEAD ZONES

(71) Applicant: Dana Canada Corporation, Oakville (CA)

(72) Inventors: Eric W. Powell, Burlington (CA); Michael Bardeleben, Oakville (CA); Allan K. So, Mississauga (CA); Andrew Buckrell, Kitchener (CA); Benjamin A. Kenney, Toronto (CA)

(73) Assignee: Dana Canada Corporation, Oakville, ON (CA)

( * ) Notice: Subject to any disclaimer, the term of this patent is extended or adjusted under 35 U.S.C. 154(b) by 308 days.

(21) Appl. No.: 14/805,125

(22) Filed: Jul. 21, 2015

(65) Prior Publication Data

US 2016/0018169 A1 Jan. 21, 2016

Related U.S. Application Data

(60) Provisional application No. 62/026,968, filed on Jul. 21, 2014.

(51) Int. Cl.

| | |
|---|---|
| ***F28D 9/00*** | (2006.01) |
| ***F28D 21/00*** | (2006.01) |
| ***F28F 13/06*** | (2006.01) |

(52) U.S. Cl.

CPC ..... *F28F 13/06* (2013.01); *F28D 9/005* (2013.01); *F28D 9/0056* (2013.01); *F28D 21/0003* (2013.01)

(58) Field of Classification Search

CPC .... F28D 21/0003; F28D 9/005; F28D 9/0056; F28D 7/024; F28F 13/06; F28F 9/22;

(Continued)

(56) References Cited

U.S. PATENT DOCUMENTS 4,742,866 A * 5/1988 Yamanaka ..... F16N 39/02 165/167
4,915,163 A * 4/1990 Matsunaga ..... F28D 1/0341 165/152

(Continued)

FOREIGN PATENT DOCUMENTS

CN 101103244 A 1/2008
CN 103517815 A 1/2014

(Continued)

OTHER PUBLICATIONS

The State Intellectual Property Office of the People's Republic of China, Office Action for Application No. 201580047540.8, dated Aug. 28, 2018, 15 pages, The State Intellectual Property Office of the People's Republic of China.

*Primary Examiner* — Edward F Landrum
*Assistant Examiner* — Melodee Jefferson
(74) *Attorney, Agent, or Firm* — Marshall & Melhorn, LLC

(57) ABSTRACT

A heat exchanger has at least one plate pair comprising first and second plates with a fluid flow passage defined between the first plate and second plates. The inlet opening and the outlet opening in each plate pair are proximate to a first end and an elongate flow barrier separates the fluid flow passage into inlet and outlet portions, wherein a gap through and the flow barrier is provided proximate to the second end of each plate pair. A flow obstruction is located in the gap of each plate pair, the flow obstruction having first and second arcuate sides and being spaced from the terminal end of the flow barrier. The flow obstruction is substantially crescent-shaped, such that a middle portion of the flow obstruction is wider than the opposed ends.

23 Claims, 22 Drawing Sheets

(58) Field of Classification Search
CPC .. F28F 13/08; F28F 9/001; F28F 9/005; F28F 3/022; Y02T 10/166; F24H 1/165; F24H 8/00; F24H 9/148
See application file for complete search history.

(56) References Cited

U.S. PATENT DOCUMENTS

| | | | | |
|---|---|---|---|---|
| 5,078,209 | A * | 1/1992 | Kerkman | F28D 9/0012 165/167 |
| 5,086,837 | A * | 2/1992 | Hagemeister | F28D 9/0043 165/167 |
| 5,125,453 | A | 6/1992 | Bertrand et al. | |
| 5,137,082 | A | 8/1992 | Shimoya et al. | |
| 5,172,759 | A | 12/1992 | Shimoya et al. | |
| 5,369,883 | A * | 12/1994 | So | F28D 9/0043 29/890.039 |
| 5,417,280 | A * | 5/1995 | Hayashi | B60H 1/3227 165/153 |
| 5,443,116 | A * | 8/1995 | Hayashi | B60H 1/3227 165/149 |
| 5,517,757 | A * | 5/1996 | Hayashi | B60H 1/3227 165/153 |
| 5,620,047 | A | 4/1997 | Nishishita | |
| 5,653,283 | A | 8/1997 | Yoshii et al. | |
| 5,662,164 | A | 9/1997 | Nishishita | |
| 5,669,439 | A | 9/1997 | Hasegawa et al. | |
| 5,735,343 | A * | 4/1998 | Kajikawa | F25B 39/022 165/146 |
| 6,032,729 | A | 3/2000 | Nishishita et al. | |
| 6,199,626 | B1 * | 3/2001 | Wu | F28D 9/0012 165/166 |
| 6,318,455 | B1 | 11/2001 | Nakado et al. | |
| 6,453,989 | B1 * | 9/2002 | Watanabe | F28D 1/0341 138/38 |
| 6,491,092 | B2 * | 12/2002 | Nakado | F28D 1/0341 165/152 |
| 6,530,423 | B2 | 3/2003 | Nakado et al. | |
| 6,543,528 | B2 | 4/2003 | Saito et al. | |
| 6,666,263 | B2 | 12/2003 | Luz et al. | |
| 6,935,418 | B1 * | 8/2005 | Valaszkai | F28F 1/022 165/109.1 |
| 7,021,371 | B2 | 4/2006 | Saito et al. | |
| 7,523,781 | B2 * | 4/2009 | Oh | F28D 1/0333 165/153 |
| 8,016,025 | B2 | 9/2011 | Brost et al. | |
| 8,596,339 | B2 | 12/2013 | Palanchon | |
| 8,678,077 | B2 * | 3/2014 | Shore | F28D 1/0325 165/153 |
| 8,683,690 | B2 * | 4/2014 | Zobel | B21C 37/151 165/177 |
| 8,985,198 | B2 * | 3/2015 | Braun | F02B 29/0462 165/149 |
| 2005/0199228 | A1 * | 9/2005 | Yamashita | F28D 7/16 123/568.12 |
| 2007/0006998 | A1 * | 1/2007 | Brost | F28D 9/005 165/167 |
| 2007/0107890 | A1 * | 5/2007 | Geskes | F28D 9/005 165/167 |
| 2007/0175619 | A1 * | 8/2007 | Watanabe | F28D 1/0341 165/166 |
| 2007/0251681 | A1 | 11/2007 | Higashiyama et al. | |
| 2007/0295026 | A1 | 12/2007 | Mori et al. | |
| 2008/0164014 | A1 * | 7/2008 | Nakamura | F28D 9/0025 165/165 |
| 2009/0126911 | A1 | 5/2009 | Shore et al. | |
| 2009/0260786 | A1 * | 10/2009 | Palanchon | F28D 9/0031 165/176 |
| 2012/0061062 | A1 * | 3/2012 | Shore | F28D 1/0325 165/134.1 |
| 2013/0061584 | A1 | 3/2013 | Gerges et al. | |
| 2014/0238641 | A1 | 8/2014 | Gerges et al. | |
| 2015/0345875 | A1 * | 12/2015 | Vallee | F28F 13/14 165/178 |
| 2016/0029516 | A1 * | 1/2016 | Sever | F28F 3/022 165/80.3 |

FOREIGN PATENT DOCUMENTS

| | | | |
|---|---|---|---|
| JP | H02106697 | A | 4/1990 |
| JP | 2002164071 | A | 6/2002 |
| WO | 2009127063 | A1 | 10/2009 |

* cited by examiner

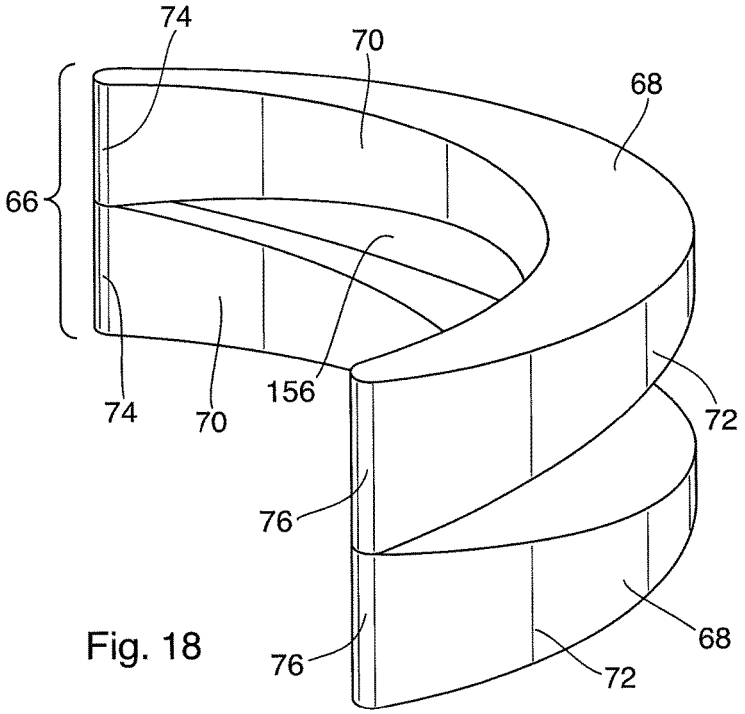
Fig. 18
Fig. 19
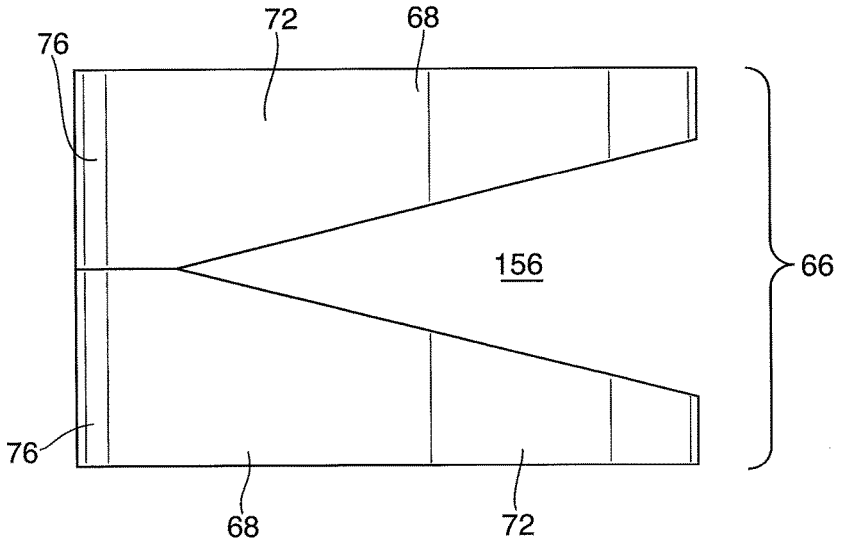

HEAT EXCHANGER WITH FLOW OBSTRUCTIONS TO REDUCE FLUID DEAD ZONES

CROSS-REFERENCE TO RELATED APPLICATION

This application claims priority to and the benefit of U.S. Provisional Patent Application No. 62/026,968 filed Jul. 21, 2014, the contents of which are incorporated herein by reference.

FIELD OF THE INVENTION

The invention generally relates to heat exchanger plates including core plates having a rib design which results in reduced fluid dead zones, particularly in heat exchangers having U-shaped flow passages for a liquid.

BACKGROUND OF THE INVENTION

Heat exchangers often include internal fluid flow passages in which the fluid must change direction at least once as it flows between an inlet and an outlet. For example, compact heat exchanger designs often place the inlet and outlet at a first end of the heat exchanger. A rib is located between the inlet and outlet and extends to a point which is close to the second end of the heat exchanger, to prevent short-circuiting of the fluid flow. The fluid is forced to flow through a gap between the terminal end of the rib and the second end of the heat exchanger, and undergoes a change in direction of 180 degrees. The fluid therefore follows a U-shaped flow path and makes two passes along the length of the plate. Examples of compact heat exchangers are described in U.S. patent application Ser. No. 14/188,070 (published as US 2014/0238641 A1), and U.S. patent application Ser. No. 13/599,339 (published as US 2013/0061584 A1), both of which are incorporated herein by reference in their entireties.

Imposing a change in the direction of an internal flow field often leads to separation of the boundary layer from the adjacent wall. The flow separation results from the presence of an adverse pressure gradient strong enough to overcome that imposed by frictional losses at the wall, causing the fluid in the boundary layer to reverse direction. Once a favorable gradient is restored, the flow may reattach to the wall, creating a zone of stagnation or low velocity recirculating flow referred to as a separation bubble. This zone is often called the wake or a dead zone.

From a design perspective, it must be realized that not all curved flows result in a local adverse pressure gradient large enough to induce flow separation. The tendency of a flow to separate is a function of the radius of curvature of the adjacent surface, the viscosity of the fluid, and the velocity of the fluid (i.e. the Reynolds Number). According to Bernoulli's principle, when a streamline is exposed to a rapid increase in flow area, such as that associated with a very small radius of curvature, the local velocity decreases sharply, in turn significantly increasing the local hydrostatic pressure and causing the flow to separate. Increasing the radius of curvature by increasing the width of the rib is not an attractive option since a wider rib will reduce the heat transfer area.

FIG. 22 shows an example of a standard U-flow core plate design with a central rib of small radius, illustrating the separation of flow along the rib immediately downstream of the point at which the fluid flow changes direction. The approximate area of flow separation is the lined area which is enclosed by dotted lines.

An example of a heat exchanger where very high wall temperatures could be expected is an Exhaust Gas Heat Recovery (EGHR) heat exchanger. The core of an EGHR heat exchanger typically comprises a plurality of flow passages for flow of a liquid coolant and a plurality of flow passages for flow of a hot exhaust gas, the coolant and exhaust flow passages alternating throughout the core structure and being defined by a stack of core plates. Heat transfer from the exhaust gas to the coolant may be enhanced by placing turbulence-enhancing inserts within the exhaust flow passages, where each insert may be bonded to the plates of the core stack along its top and bottom surfaces.

Where the EGHR heat exchanger includes U-shaped or serpentine flow passages for the coolant, the presence of dead zones not only degrades the overall heat transfer coefficient, but also increases the risk that a water-containing coolant circulating through the heat exchanger can boil. Where the fluid circulating through the heat exchanger is transmission fluid or engine oil, it is possible for the fluid to become overheated to the point that coking will occur in these dead zones.

Increasing the width of the rib in such an EGHR heat exchanger will lead to a decrease in the heat transfer area in the coolant flow passages, due to the space occupied by the rib. In the exhaust flow passages, the core plates will be unbonded and out of contact with the turbulence-enhancing inserts in the area of the rib, and therefore widening the rib will similarly reduce the heat transfer area in the exhaust flow passages. The inclusion of additional ribs and dimples in the coolant flow passages will have a similar negative effect on the heat transfer area in the coolant and exhaust flow passages.

There remains a need for a heat exchanger structure which will avoid the formation of dead zones under a range of operating conditions.

SUMMARY OF THE INVENTION

According to one aspect, there is provided a heat exchanger comprising: (a) at least one plate pair comprising a first plate and a second plate and having a first end and a second end; (b) a fluid flow passage for flow of a first fluid defined between the first plate and the second plate of each of said plate pairs; (c) an inlet opening and an outlet opening provided in each of said plate pairs, wherein the fluid flow passage extends between the inlet opening and the outlet opening, and wherein the inlet opening and the outlet opening in each said plate pair are proximate to the first end; (d) an elongate flow barrier separating the fluid flow passage of each said plate pair into an inlet portion in which the inlet is located, and an outlet portion in which the outlet is located, wherein the flow barrier extends from the first end to a terminal end proximate to the second end of the plate pair, and wherein the flow barrier includes a gap through which fluid flow communication is provided between the inlet portion and the outlet portion of the fluid flow passage; and (e) a flow obstruction located in the gap of each said plate pair, the flow obstruction having a pair of opposed ends, a first side and an opposed second side, wherein the first and second sides are arcuate, with the first side facing the terminal end of the flow barrier and spaced therefrom. The flow obstruction is substantially crescent-shaped and the first and second sides of the flow obstruction intersect at the opposed ends thereof; wherein the first and second sides of the flow obstruction each describe a portion of a smoothly rounded shape, wherein the portion of the smoothly rounded shape described by the second side is larger than the portion of the rounded shape described by the first side, such that a middle portion of the flow obstruction is wider than the opposed ends.

In an embodiment, each of the first and second sides of the flow obstruction approximate an arc of a circle having a center which lies on a central longitudinal axis of each of the first and second plates, the centers of the circles approximating shapes of the first and second sides being spaced apart along said axis, and the circle approximating the shape of the second side having a larger radius than the circle approximating the shape of the first side.

In an embodiment, the terminal end of the flow barrier is arc-shaped, and wherein an arcuate space of substantially constant width is defined between the terminal end of the flow barrier and the first side of the flow obstruction.

In an embodiment, a curvature of the first side of the flow obstruction deviates away from a circular arc proximate to the opposed ends, such that a width of the arcuate space proximate to the ends is larger than a width of the arcuate space at the middle portion of the flow obstruction.

In an embodiment, the flow barrier of each said plate pair is substantially straight and parallel to a central longitudinal axis extending between the first and second ends of the plate pair; and wherein the flow obstruction is symmetrical about the central longitudinal axis.

In an embodiment, the flow obstruction increases in width from the opposed ends to the central longitudinal axis in a gradual manner.

In an embodiment, the flow obstruction has a transverse length between the opposed ends along a line which is substantially perpendicular to the central longitudinal axis, and wherein a ratio of the transverse length to a maximum width of the flow barrier is at least about 2:1.

In an embodiment, the line defining the transverse length of the flow barrier passes through the widest part of the flow barrier.

In an embodiment, the second side of the flow obstruction is shaped in portions thereof immediately adjacent to the opposed ends such that an included angle between the transverse line and each of said portions immediately adjacent to the opposed ends is in the range from about 60 degrees to about 120 degrees.

In an embodiment, the opposed ends of the flow obstruction are shaped so as to extend inwardly toward one another and toward a sidewall of the flow barrier.

In an embodiment, the opposed ends of the flow obstruction extend inwardly by an amount which reduces flow separation in the outlet portion of the fluid flow passage while avoiding flow restriction between the flow barrier and the end of the flow barrier located in the inlet portion of the fluid flow passage.

In an embodiment, the ends of the flow obstruction have a bulbous shape, wherein each of the bulbous shapes is partly defined by an inwardly-extending surface provided on the first side of the flow obstruction.

In an embodiment, each of the bulbous shapes is partly defined by an outwardly-extending surface provided on the second side of the flow obstruction.

In an embodiment, each of the bulbous shapes is partly defined by a smooth arcuate shape of the second side of the flow obstruction.

In an embodiment, the flow obstruction is formed by a pair of crescent-shaped protrusions extending upwardly from a base of each of the first and second core plates, each of the crescent-shaped protrusions having a top surface.

In an embodiment, each of the crescent-shaped protrusions has a height which is substantially the same as a height of the first or second core plate, and wherein the top surfaces of the crescent-shaped protrusions are sealingly joined together such that the flow obstruction is free of perforations.

In an embodiment, each of the crescent-shaped protrusions has a height which is less than a height of the first or second core plate, and wherein the crescent-shaped protrusions have top surfaces which are spaced apart so as to provide a gap between the top surfaces of the crescent-shaped protrusions, wherein the gap extends through the flow obstruction from the first side to the second side.

In an embodiment, the top surface of each said crescent-shaped protrusion is flat and parallel to the base of the first or second core plate from which it extends, such that the gap is continuous and extends throughout an entire length and width of the flow obstruction. In an embodiment, the gap is of substantially constant height. In an embodiment, the gap has a height which is no more than about 25 percent of a height of the fluid flow passage.

In an embodiment, the top surface of each said crescent-shaped protrusion is downwardly sloped from the opposed ends of the flow obstruction toward the middle portion thereof, such that the gap has a maximum height in the middle portion of the flow obstruction.

In an embodiment, the top surface of each said crescent-shaped protrusion is downwardly sloped from the first side to the second side of the flow obstruction, such that the gap increases in height from the first side to the second side.

In an embodiment, the top surfaces of the crescent-shaped protrusions are joined together in areas proximate to the opposed ends.

In an embodiment, each said crescent-shaped protrusion has a stepped configuration, with a higher portion proximate to the first side of the flow obstruction and a lower portion proximate to the second side of the flow obstruction, wherein the higher and lower portions are separated by a shoulder. In an embodiment, the higher and lower portions of each said crescent-shaped protrusion have substantially the same width. In an embodiment, the higher portion of each said crescent-shaped protrusion has a height which is substantially the same as a height of the first or second core plate, and wherein the top surfaces along the higher portions of the crescent-shaped protrusions are sealingly joined together such that the flow obstruction is free of perforations along the first side thereof.

In an embodiment, the top surfaces along the lower portions of the crescent-shaped protrusions are spaced apart from one another so as to provide a gap between the top surfaces along the lower portions of the crescent-shaped protrusions, wherein the gap extends from the shoulder to the second side of the flow obstruction.

In an embodiment, the flow barrier of each said plate pair has a width at its terminal end which is greater than a width of the flow barrier at the first end of the plate pair.

In an embodiment, the terminal end of each said flow barrier is rounded. In an embodiment, the terminal end of each said flow barrier defines a portion of an ellipse, oval or a circle.

In an embodiment, a distance between the first side of the flow obstruction and the terminal end of the flow barrier is less than a distance between the first side of the flow obstruction and the second end of the plate pair. In an embodiment, the first side of the flow obstruction is arcuate, and generally follows a fluid flow path through the gap.

In an embodiment, the flow obstruction has opposite ends which are generally parallel to the flow barrier.

In an embodiment, one or both of the flow barrier and the flow obstruction comprises a series of spaced apart ribs and/or dimples.

In an embodiment, the heat exchanger comprises a plurality of said plate pairs arranged in a stack, the plurality of plate pair defining a plurality of said fluid flow passages, wherein the inlet openings of the plurality of plate pairs are aligned to form an inlet manifold, and wherein the outlet openings of the plurality of plate pairs are aligned to form an outlet manifold, wherein the plurality of fluid flow passages are for flow of a first fluid.

In an embodiment, adjacent plate pairs in said stack are spaced apart from one another to provide a plurality of passages for flow of a second fluid.

In an embodiment, the first and second plates of each said plate pair are sealed together at their peripheral edges, and wherein portions of the first and second plates located inwardly of the peripheral edges are substantially flat and parallel to one another.

In an embodiment, the heat exchanger is a gas to liquid heat exchanger, with the first fluid being a liquid and the second fluid being a hot gas.

In an embodiment, the first fluid is a liquid coolant, and the heat exchanger is: (a) an exhaust gas heat recovery (EGHR) heat exchanger with the hot gas being hot exhaust gas; or (b) a charge air cooler with the hot gas being charge air.

In an embodiment, the heat exchanger is a liquid to liquid heat exchanger, wherein the first fluid is engine oil or transmission oil, and the second fluid is a liquid coolant.

In an embodiment, the flow barrier has substantially straight sides which diverge from one another from the first end to the terminal end, and wherein the terminal end is smoothly rounded.

In an embodiment, the flow barrier has an arrowhead shape with a small, generally angular side protrusions extending transversely from opposite sides of the flow barrier, and wherein the terminal end further includes inwardly directed sides meeting at a rounded tip of the terminal end.

In an embodiment, the terminal end of the flow barrier has a rounded arrowhead shape with arcuately curved sides extending transversely from opposite sides of the flow barrier, and then extending inwardly toward a rounded tip.

BRIEF DESCRIPTION OF THE DRAWINGS

The embodiments will now be described, by way of example only, with reference to the accompanying drawings in which:

FIG. 18 is an isolated perspective view of a flow obstruction according to another embodiment;

FIG. 19 is a side elevation of the flow obstruction of FIG. 18;

DETAILED DESCRIPTION

Heat exchangers according to several embodiments are now described below. The drawings and the following description illustrate heat exchanger core plates and gas/liquid heat exchanger core structures which may be used for cooling hot exhaust gases in vehicles equipped with exhaust gas recirculation (EGR) or exhaust gas heat recovery (EGHR) systems. For example, in an EGHR system, a heat exchanger as described herein may be combined with a gas diverter valve (not shown), as described in above-mentioned U.S. patent application Ser. Nos. 13/599,339 and 14/188,070.

It will be appreciated that the heat exchangers described herein may be used in other applications where heat must be removed from hot gas streams. For example, the heat exchangers as described herein may be adapted for use as gas/liquid charge air coolers for cooling of intake air (or "charge air") in turbocharged or supercharged engines.

In other applications, the heat exchangers as described herein can be used as liquid/liquid heat exchangers to provide heating and/or cooling of vehicle fluids such as engine oil and transmission fluid.

Figure 1A:
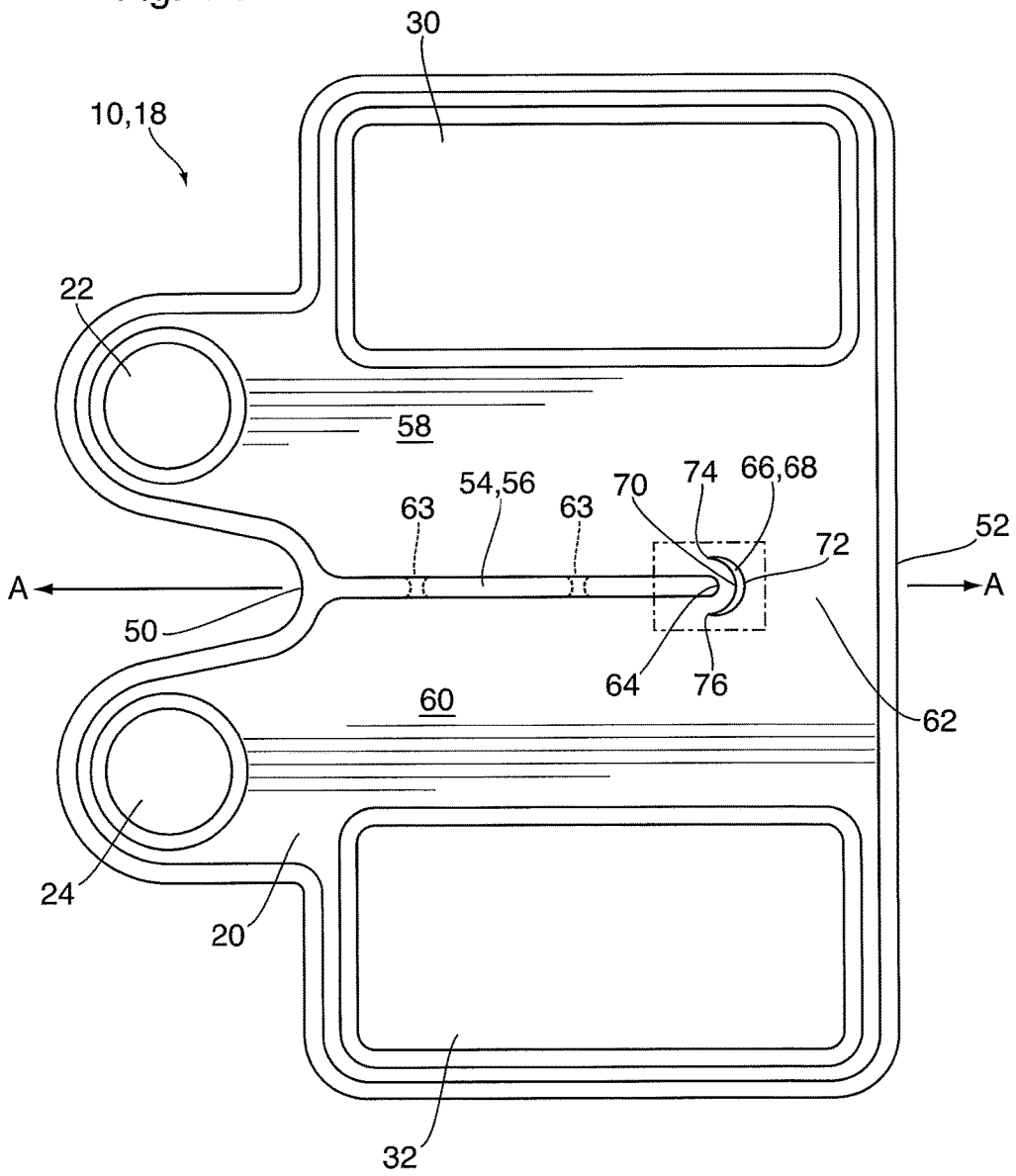
FIG. 1A is a plan view of a heat exchanger core plate/plate pair according to an embodiment described herein.
Figure 1B:
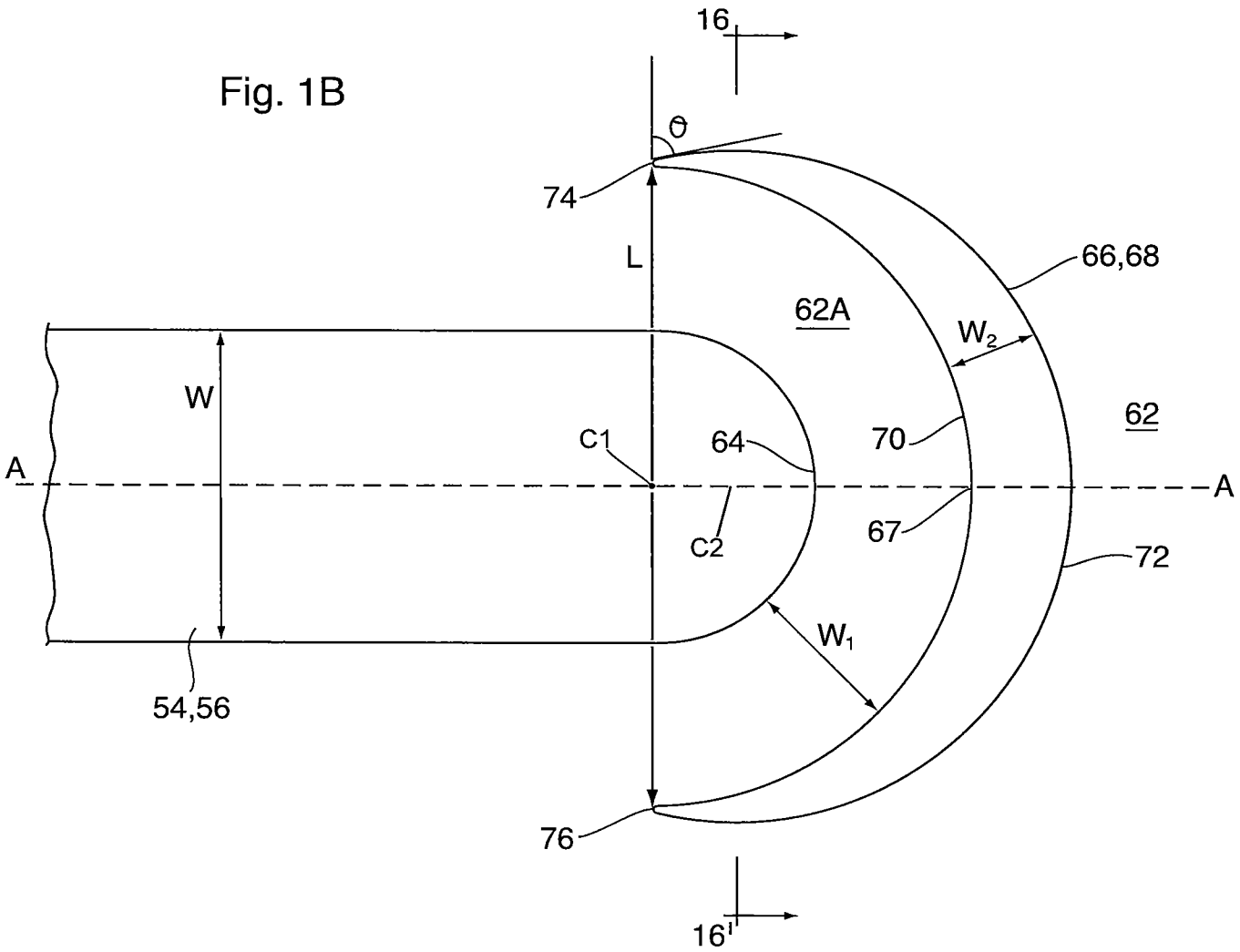
FIG. 1B is a close-up of the area of FIG. 1A enclosed in dotted lines.
Figure 2:
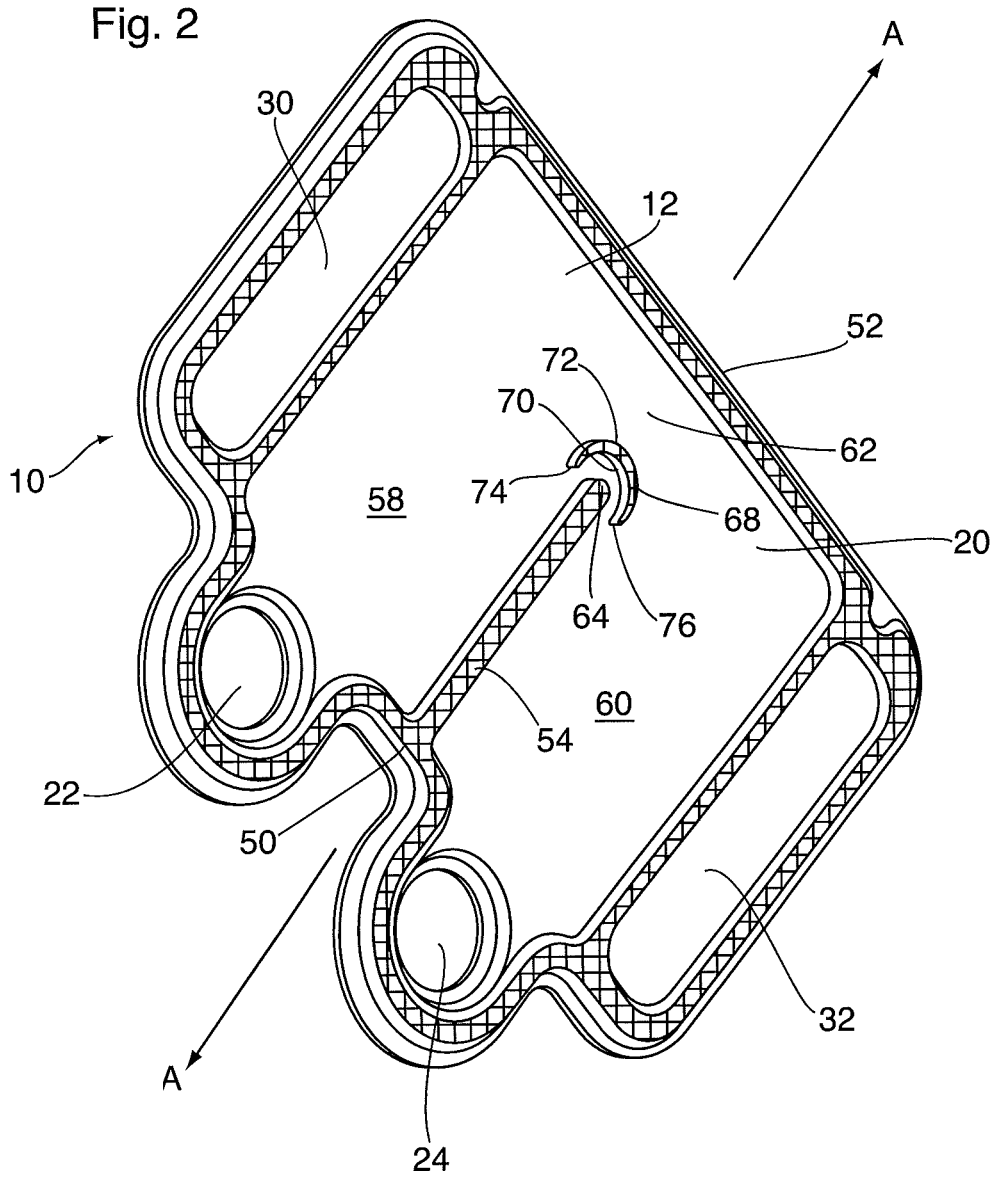
FIG. 2 is a perspective view of the liquid side of the heat exchanger core plate of FIG. 1A.
Figure 3:
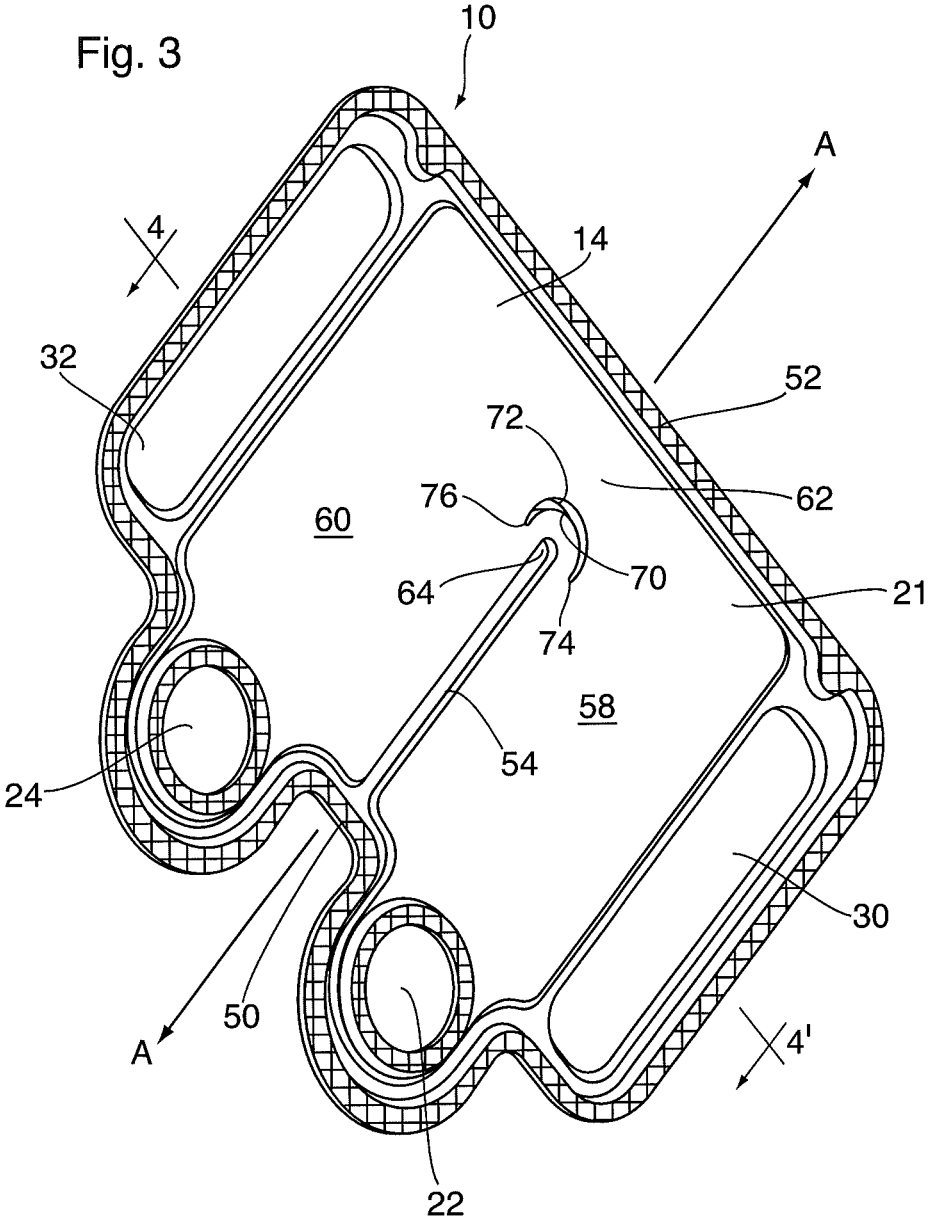
FIG. 3 is a perspective view of the gas side of the heat exchanger core plate of FIG. 1A.

FIGS. 1A to 5 illustrate heat exchanger core plates 10 and/or plate pairs 18 according to an embodiment, for use in a gas/liquid EGHR heat exchanger. FIG. 1A is a plan view of a core plate 10/plate pair 18, and FIGS. 2 and 3 are perspective views showing the respective first side 12 and second side 14 of a core plate 10. Since the present embodiment relates to a gas/liquid EGHR heat exchanger, the first side 12 is referred to herein as the "liquid side" 12, and the second side 14 is referred to herein as the "gas side". The liquid side 12 is the side of plate 10 which defines, in part, one of the liquid flow passages (also referred to herein as the "first fluid flow passages"), while the gas side 14 denotes the side of plate 10 which defines, in part, one of the gas flow passages (also referred to herein as the "second fluid flow passages").

Figure 4:
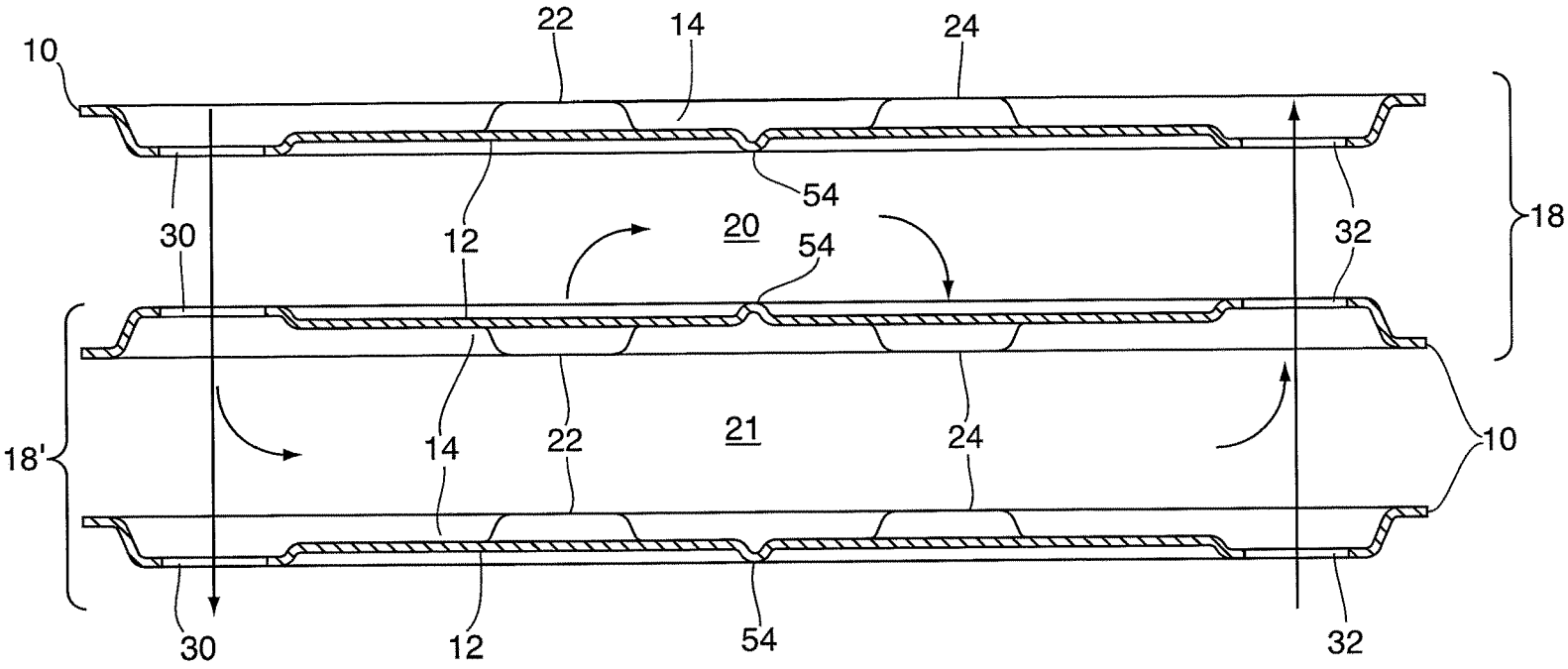
FIG. 4 is a cross-sectional side view through the gas openings of a plurality of heat exchanger core plates according to FIG. 2, the section being taken along line 4-4' of FIG. 3.
Figure 5:
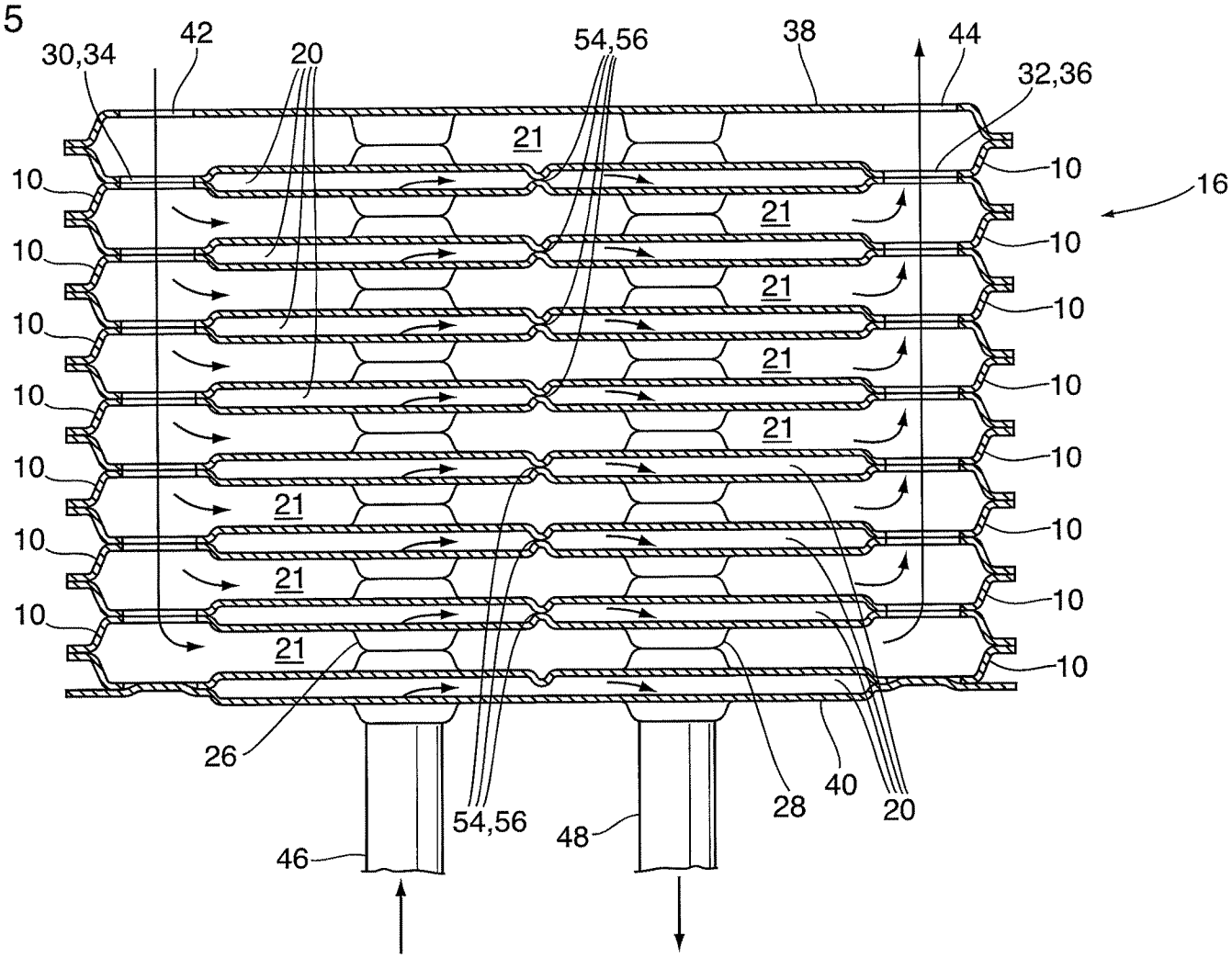
FIG. 5 is a cross-sectional side view through the gas manifolds of a heat exchanger core comprising the plates of FIG. 4.

The core plates 10 are sealingly joined together in a stack to form a heat exchanger 16, which is shown in the cross-section of FIG. 5. The relative orientations of the core plates 10 in heat exchanger 16 are shown in the disassembled, enlarged cross-section of FIG. 4. As shown in FIGS. 4 and 5, the heat exchanger 16 comprises a plurality of plate pairs 18, each of which comprises a pair of core plates 10 sealed together with the liquid side 12 of one core plate 10 facing the liquid side 12 of an adjacent core plate 12, with the first fluid (liquid) flow passage 20 being defined between the liquid sides 12 of the core plates 10 making up each plate pair 18. The portions of the core plates 10 between which the first fluid flow passages 20 are defined are substantially flat and parallel to one another. The core plates 10 of each plate pair 18 are sealed together, for example by brazing, along the flat-topped sealing surfaces on the liquid side 12 of the core plates 10, these surfaces being highlighted by cross-hatching in FIG. 2.

Adjacent plate pairs 18 in the heat exchanger 16 are sealed together, for example by brazing, along the flat-topped sealing surfaces on the gas side 14 of the core plates 10, such that second fluid (gas) flow passages 21 are defined between the gas sides 14 of the core plates 10 in adjacent plate pairs 18. The sealing surfaces between adjacent plate pairs 18 are highlighted by cross-hatching in FIG. 3.

It will be appreciated that the above definition of the plate pairs 18 as a pair of plates 10 with their liquid sides 12 facing one another is arbitrary. The plate pairs 18 are defined in this way because the following description focuses on features which are located within the first fluid flow passages 20 of the heat exchanger 16. It will be appreciated that the plate pairs 18 could instead be defined as having the gas side 14 of one core plate 10 facing the gas side 14 of an adjacent core plate 10 in the core 16. This alternate plate pair construction is identified in FIG. 4 by reference numeral 18'. The heat exchanger 16 described herein is a "self-enclosed" heat exchanger in which both the first and second fluid flow passages 20, 21 are enclosed within the sealed edges of adjacent core plates 10. Accordingly, the heat exchanger 16 defined herein does not require an external housing. It will be appreciated, however, that the heat exchanger 16 is not necessarily self-enclosed, and may be surrounded by a housing having interior manifold spaces communicating with the second fluid (gas) flow passages 21.

Each core plate 10 and each plate pair 18 includes a first fluid inlet opening 22 and a first fluid outlet opening 24. These openings 22 and 24 extend through both core plates 10 of each plate pair 18. When the plates 10 are stacked to form heat exchanger 16, the inlet and outlet openings 22, 24 are aligned to form corresponding inlet and outlet manifolds 26, 28 for the first fluid, extending throughout the height of heat exchanger 16. In the present embodiment relating to a gas/liquid EGHR heat exchanger, the first fluid is a liquid coolant, such as a mixture of water and glycol.

Each of the core plates 10 also has a second fluid inlet opening 30 and a second fluid outlet opening 32 extending along its opposite sides. When the plates 10 are stacked to form heat exchanger 16, the inlet and outlet openings 30, 32 are aligned to form corresponding inlet and outlet manifolds 34, 36 for the second fluid, extending throughout the height of heat exchanger 16. In the present embodiment relating to a gas/liquid EGHR heat exchanger, the second fluid is a hot exhaust gas. Where the heat exchanger 16 is not self-enclosed, the core plates 10 will not have openings for the second fluid. Rather, inlet and outlet manifold spaces would be provided in a housing surrounding the heat exchanger 16.

As can be seen from FIGS. 1A and 2 to 5, the core plates 10 of heat exchanger 16 may be identical and symmetrical, with the central longitudinal axis A serving as the axis of symmetry. However, in order to close the ends of the manifolds and to allow connection to other components, the heat exchanger 16 also includes differently configured top and bottom plates 38, 40. The top plate 38 has inlet and outlet openings 42, 44 for the second fluid aligned with the second fluid manifolds 34, 36, but lacks any openings for the first fluid. Therefore top plate 38 closes the upper ends of the first fluid manifolds 26, 28 but is configured to permit passage of the second fluid. Where heat exchanger 16 is an EGHR heat exchanger, the second fluid is a hot exhaust gas and the top plate 18 may be attached directly or indirectly to a gas diverter valve (not shown).

The bottom plate 40 has inlet and outlet openings (not shown) which may be provided with respective inlet and outlet fittings 46, 48 for the first fluid. These openings and fittings 46, 48 are aligned with the first fluid manifolds 26, 28. However, the bottom plate 40 lacks any openings for the second fluid. Therefore, bottom plate 40 closes the lower ends of the second fluid manifolds 34, 36 but is configured to permit passage of the first fluid. Where heat exchanger 16 is an EGHR heat exchanger, the first fluid is a liquid coolant and the fittings 46, 48 are connected to a coolant circulation system (not shown). It will be appreciated that the specific configurations of the top and bottom plates 38, 40 and their openings will depend on a number of factors, including packaging constraints, and may not necessarily appear as shown in the drawings.

For the purpose of the following description, the core plates 10 and the plate pairs 18 are described as having a first end 50 and a second end 52, wherein the central longitudinal axis A extends between the first and second ends 50, 52.

Heat exchanger 16 has a compact core design, with the core plates 10 each having upwardly extending elongate ribs 54 on the liquid side 12. As can be seen from FIG. 2, the cross-hatched sealing surface on the liquid side 12 includes the upper surface of the rib 54 which is shown as being flat in FIGS. 1A to 3, but which may be rounded. The ribs 54 of the two core plates 10 making up each plate pair 18 align with and are sealed together, for example by brazing, to form an elongate flow barrier 56.

The flow barrier 56 separates the first fluid flow passage 20 of each plate pair into an inlet portion 58 which includes the first fluid inlet opening 22 and an outlet portion 60 which includes the first fluid outlet opening 24.

The ribs 54 and flow barrier 56 may be straight, and/or may extend along or parallel to the axis A for a portion of the distance between the first end 50 and the second end 52. In the examples shown in the drawings, the ribs 54 and flow barrier 56 are co-axial with the central longitudinal axis A. The ribs 54 and flow barrier 56 include a gap 62 in which portions of one or both ribs 54 of the core plates 10 making up a plate pair 18 are reduced in height or eliminated. Fluid flow communication between the inlet portion 58 and the outlet portion 60 of the first fluid flow passage 20 is provided through this gap 62.

In the illustrated embodiment, the ribs 54 and flow barrier 56 extend from the first end 50 to a terminal end 64 of the ribs 54 and flow barrier 56, the terminal end 64 being proximate to, and spaced from, the second end 52, such that the gap 62 is defined between the terminal end 64 and the second end 52.

Also, in this embodiment the ribs 54 and the flow barrier 56 are continuous between the first end 50 and the terminal end 64. However, it will be appreciated that this is not essential. For example, the ribs 54 and the flow barrier 56 may be discontinuous, comprising axially spaced intermittent ribs and/or dimples, for example as shown and described in above-mentioned U.S. patent application Ser. No. 14/188,070, and as shown by the dotted lines extending transversely across rib 54/flow barrier 56 in FIG. 1A. In embodiments with a discontinuous rib 54 and discontinuous flow barrier 56, there will be one or more additional gaps 63, shown in FIG. 1A, through which a portion of the first fluid may flow between the inlet portion 58 and the outlet portion 60. However, in the present embodiment, all of the first fluid must flow through the gap 62 between the inlet portion 58 and the outlet portion 60.

In the compact construction of heat exchanger 16, the first fluid inlet opening 22 and the first fluid outlet opening 24 are both located proximate to the first end 50 of the core plates 10 and plate pair 18. Thus, it can be seen that the first fluid must follow a U-shaped fluid flow path as it flows through the first fluid flow passage 20 from the inlet opening 22 to the outlet opening 24. It can also be seen that the ribs 54 and flow barrier 56, being located between the inlet and outlet openings 22, 24, will prevent short-circuit flow of the first fluid, and will cause the flow of the first fluid to be distributed across the liquid side 12 of the core plates 10.

In order to maximize the heat transfer area of the core plates 10, the widths of ribs 54 may be minimized along at least a portion of their length. In this regard, the flat tops of ribs 54 may be made narrower or eliminated altogether, such that the tops of ribs 54 have a more rounded appearance. Although the widths of the ribs 54 and the flow barrier 56 will depend to some extent upon the area of core plates 10, in the embodiments described herein, the ribs 54 and flow barrier 56 may have a width of less than about 10 mm, for example less than about 6 mm, and in some embodiments from about 2.5 to about 5 mm.

FIG. 1B is an enlarged plan view of the terminal end 64 of the rib 54/flow barrier 56 and the protrusion 68/flow obstruction 66 of the core plate 10/plate pair 18 shown in FIG. 1A. According to this embodiment, the terminal end 64 of the ribs 54 and flow barrier 56 is smoothly rounded, and may approximate a semi-circle, with the width of the rib (labeled as "W" in FIG. 1B) corresponding to the diameter of the semi-circle, and the centre of the semi-circle (labeled as "C1" in FIG. 1B) lying along the central longitudinal axis A.

The plate pairs 18 of heat exchanger 16 further comprise a structure, generally referred to herein as a "flow obstruction" 66 located in the gap 62. In the illustrated embodiments, the flow obstruction 66 is in the form of a crescent-shaped flow-splitting structure formed by a pair of identical crescent-shaped protrusions 68, each extending upwardly on the liquid side 12 of one of the core plates 10 making up a plate pair 18. In the first embodiment, the crescent-shaped protrusions 68 making up flow obstruction 66 each have a flat top surface along which the ribs 68 are sealed together, for example by brazing, such that there is no fluid flow through the flow obstruction 66. Thus, as can be seen from FIG. 2, the cross-hatched sealing surface on the liquid side 12 includes the entire flat upper surface of the protrusion 68. Therefore, in the first embodiment, the protrusions 68 of the two core plates 10 making up each plate pair 18 align with and are sealed together along their upper surfaces to form the flow obstruction 66.

As shown in FIG. 2, the protrusions 68 and flow obstruction 66 are located in the gap 62, and may be symmetrical about the central longitudinal axis A, wherein a middle portion of the protrusions 68 and flow obstruction 66 is defined as the portion of the protrusions 68 and flow obstruction 66 proximate to the central longitudinal axis A, and identified by reference numeral 67 in FIG. 1B.

The flow obstruction 66 has a first side 70 which is located opposite to (i.e. facing) the terminal end 64 of the ribs 54 and flow barrier 56, and spaced therefrom. In the first embodiment, the distance from first side 70 of flow obstruction 66 to the terminal end 64 of rib 54 is less than the distance from the first side 70 of flow obstruction 66 to the second end 52 of plate pair 18 or core plate 10. In other words, the flow obstruction 66 is closer to the rib 54 than to the second end 52 of plate pair 18. The spacing between the first side 70 of flow obstruction 66 and the terminal end 64 of rib 54 may be variable due to differences in the shapes of the first side 70 and the terminal end 64, both of which may be rounded. However, the spacing along axis A between the first side 70 of flow obstruction 66 and the terminal end 64 of rib 54 in the embodiments described herein may be less than about 10 mm, for example less than about 6 mm, and in some embodiments from about 2.5 to about 5 mm.

In the illustrated embodiments, the first side 70 of flow obstruction 66 is arcuate, and generally follows the curvature of the fluid flow path through the gap 62. Also, in the illustrated embodiments, the radius of curvature of the first side 70 of flow obstruction 66 is greater than that of the terminal end 64 of rib 54, such that the radial spacing between the terminal end 64 and the first side 70 of flow obstruction 66 is relatively constant.

The protrusions 68 and flow obstruction 66 also have a second side 72 opposite to the first side 70. In the illustrated embodiment, the protrusions 68 and flow obstruction 66 are substantially crescent-shaped, with the second side 72 of the protrusions 68 and flow obstruction 66 being arcuate and also following the curvature of the fluid flow path through the gap 62.

Each of the first and second sides 70, 72 of the protrusions 68 and flow obstruction 66 is generally smoothly shaped and may describe a portion of a circle or other symmetrical, smoothly rounded shape such as an ellipse, oval, etc. The portion of the rounded shape described by the second side 72 will generally be larger than the portion of the rounded shape described by the first side 70, such that the sides 70, 72 intersect at two points which correspond to the opposite ends 74, 76 of the protrusions 68 and flow obstruction 66. The ends 74, 76 are sometimes referred to herein as the "tips", and are located on opposite sides of central longitudinal axis A.

In the illustrated examples the first and second sides 70, 72 may each approximately describe an arc of a circle, the centre of which lies on the central longitudinal axis A. The centres C1, C2 of the circles approximating first and second sides 70, 72 are spaced apart from one another, and the radius of the circle approximating the shape of second side 72 is larger than that of the circle approximating the shape of first side 70, and both radii are larger than the radius of the semi-circle defining the shape of the terminal end 64 of the ribs 54 and flow barrier 56. In the present embodiment, centre C1 is the centre of the circle approximated by the first side 70 of flow obstruction 66, and is also the centre of the semi-circle approximated by the terminal end 64 of flow barrier 56.

As can be seen from the drawings, the arc shape of the terminal end 64, and the arc-shape of the first side 70 produces an arcuate space 62A of substantially constant width (labeled as "$W_1$" in FIG. 1B) between the flow barrier 56 and the flow obstruction 66, wherein width $W_1$ is measured radially from the centre C of the semi-circle defining the curvature of the terminal end 64 of the ribs 54 and flow barrier 56. In practice, however, the curvature of the first side 70 of the protrusions 68 and flow obstruction 66 may deviate away from a circular arc, and be somewhat flattened in the area of the ends 74, 76, such that the width $W_1$ of the arcuate space 62A between the flow barrier 56 and the flow obstruction 66 is slightly larger at the ends 74, 76 than along the central longitudinal axis A.

The provision of an arcuate space 62A of substantially constant width $W_1$ along the first side 70 of the protrusions 68 and flow obstruction 66 is beneficial in encouraging uniform splitting of the flow at the first end 74 of the protrusions 68 and flow obstruction 66. Also, the larger curve described by the second side 72 of protrusions 68 and flow obstruction 66 effectively increases the radius of curvature of the surface around which a portion of the fluid flows through the gap 62. As described above, the provision of the larger radius of curvature will reduce the tendency of the flow to separate, in accordance with Bernoulli's principle.

Thus, the function of the flow obstruction 66 and the benefits provided thereby are influenced by the degrees of curvature of the first and second sides 70, 72 of the protrusions 68 and flow obstruction 66. The inventors have found that the greatest benefits in reduction of flow separation are provided where the protrusions 68 and flow obstruction 66 are generally crescent-shaped, increasing in width (labeled as "$W_2$" in FIG. 1B), as measured radially from a point along axis A from the ends 74, 76 to the middle portion 67 and the central longitudinal axis A in a gradual manner. Further, the inventors have found that the benefits in reduction of flow separation are increased by increasing the width $W_2$ of the protrusions 68 and flow obstruction 66, for example by increasing the radius and/or arc length of the second side 72 of the protrusions 68 and flow obstruction 66, without a corresponding increase in the radius and/or arc length of the first side 70. However, expanding the width $W_2$ of the protrusions 68 and flow obstruction 66 will reduce the heat transfer area in both the first and second fluid flow passages 20, 21, as explained above with reference to the rib 54, and therefore the benefit produced by widening the protrusions 68 and flow obstruction 66 will have a practical upper limit, above which the heat transfer area is reduced to a point at which the performance of the heat exchanger will be negatively affected. For example, in an EGHR cooler, the maximum width $W_2$ of the protrusions 68 and flow obstruction 66, measured along the central longitudinal axis A, will be less than about 10 mm, for example less than about 6 mm, and in some embodiments from about 2.5 to about 5 mm.

A transverse length of the protrusions 68 and flow obstruction 66 is defined as the distance between the ends 74, 76 along a line L which is perpendicular or substantially perpendicular to the central longitudinal axis A. The inventors have found that an effective ratio of the transverse length along line L to the maximum width W of ribs 54 and flow barrier 56 is at least about 2:1. The minimum ratio of L:W of about 2:1 will produce a spacing between the terminal end 64 of flow barrier 56 and the first side 70 of flow obstruction 66 which is about half the maximum width W of the ribs 54 and flow barrier 56.

The line L defining the transverse length of the protrusions 68 and flow obstruction 66 may typically pass through the widest part of the ribs 54 and flow barrier 56. In the first embodiment, line L also passes through the centre of curvature C of the terminal end 64 of ribs 54 and flow barrier 56. However, it will be appreciated that this is not essential, and that line L connecting ends 74 and 76 may be located closer to the first end 50 of the core plate 10/plate pair 18. For example, in FIGS. 7 and 8 discussed below, line L does not pass through the widest part of the rib 54/flow barrier 56, and is located between the widest part of the rib 54/flow barrier 56 and the first end of the core plate 10/plate pair 18. It will also be appreciated that the transverse length defined by line L is different from the lengths of the arcs described by the first and second sides 70, 72 of the protrusions 68/flow obstruction 66.

The inventors have found that it is beneficial to shape the second side 72 of the protrusions 68 and flow obstruction 66, in the areas immediately adjacent to ends 74, 76, such that an included angle θ between the transverse line L and the second side 72 immediately adjacent to ends 74, 76 is in the range from about 60 to about 120 degrees. Typically, angle θ is less than about 90 degrees, for example in the range from about 60 to 90 degrees, or from about 75-90 degrees. Where this angle is much smaller than 90 degrees, the inventors have found that a wake zone may form in an area adjacent to the end 74 closest to the first fluid inlet opening 22.

In the first embodiment, the ends 74, 76 of the protrusions 68 and flow obstruction 66 are slightly rounded. In addition, as will be further explained below, the areas of protrusions 68 and flow obstruction 66 immediately adjacent to the ends 74, 76 may be shaped so as to further reduce flow separation.

As will be appreciated from the above discussion, the addition of the protrusions 68 and flow obstruction 66 to core plates 10 reduces the tendency of the fluid flow to separate and form dead zones. In this regard, the protrusions 68 and flow obstruction 66 are shaped to split the flow of the first fluid as it changes direction and flows through the gap 62. The splitting of the fluid flow reduces the local flow velocity at the terminal end 64 of ribs 54 and flow barrier 56, the flow velocity also being a factor contributing to flow separation. The addition of the protrusions 68 and flow obstruction 66 effectively reduces the bend radius required to prevent flow separation. In addition, the close proximity of the protrusions 68 and flow obstruction 66 to the terminal end 64 of ribs 54 and flow barrier 56 creates a narrow channel between terminal end 64 and first side 70 which reduces the hydraulic diameter and hence the Reynolds number. This also contributes to the reduction of flow separation. Thus, the combination of ribs 54 and flow barrier 56 with the protrusions 68 and flow obstruction 66 reduces the tendency for flow separation, while minimizing the width of ribs 54 and flow barrier 56 along their lengths.

Alternate configurations of ribs 54 and flow barrier 56 are now discussed below. In these drawings, like elements are identified by like reference numerals.

Figure 6:
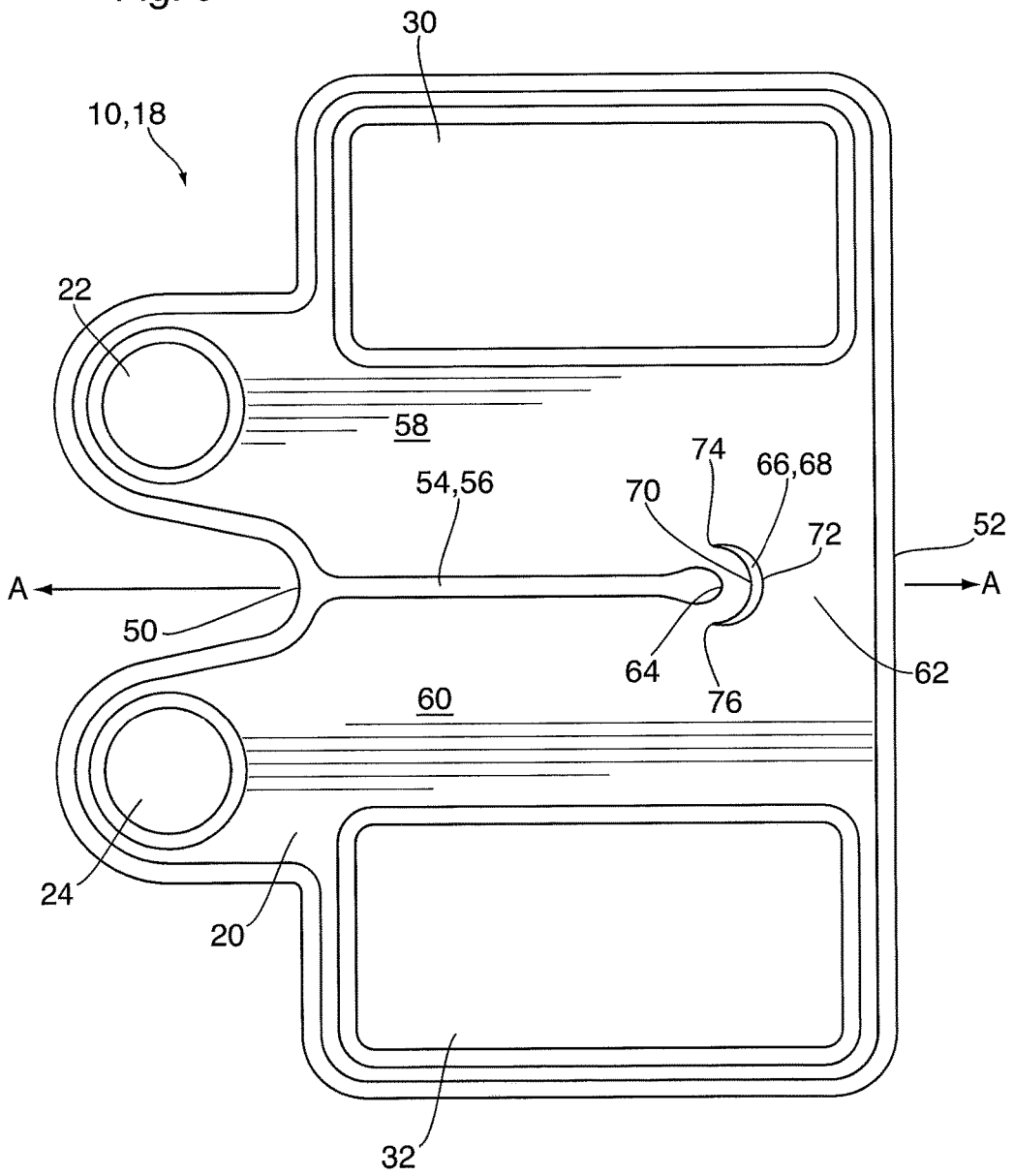
FIG. 6 is a plan view of a core plate/plate pair according to another embodiment.

In order to help avoid the creation of dead zones in the first fluid flow passage 20, the widths of the ribs 54 and the flow barrier 56 at the terminal end 64, proximate to the gap 62, may be greater than the widths of the ribs 54 and the flow barrier 56 at the first end 50 of the plate pair 18. For example, as shown in FIG. 6, the terminal end 64 may be expanded in width relative to the remainder of ribs 54 and flow barrier 56, having a rounded shape which may define a portion of an ellipse, oval, circle, bulbous or other rounded shape.

The widening at the terminal end 64 of ribs 54 and flow barrier 56 allows the width of the ribs 54 and flow barrier 56 to be minimized over most of their length, so as to maximize the heat transfer area, while increasing the radius of the ribs 54 and the flow barrier 56 at the terminal end 64. As explained above, the flow of the first fluid around the terminal end 64 of a rib 54 or flow barrier 56 with a very small radius of curvature is a factor contributing to flow separation. Thus, by increasing the radius of curvature at the terminal end 64, the tendency of the flow to separate is reduced.

Figure 7:
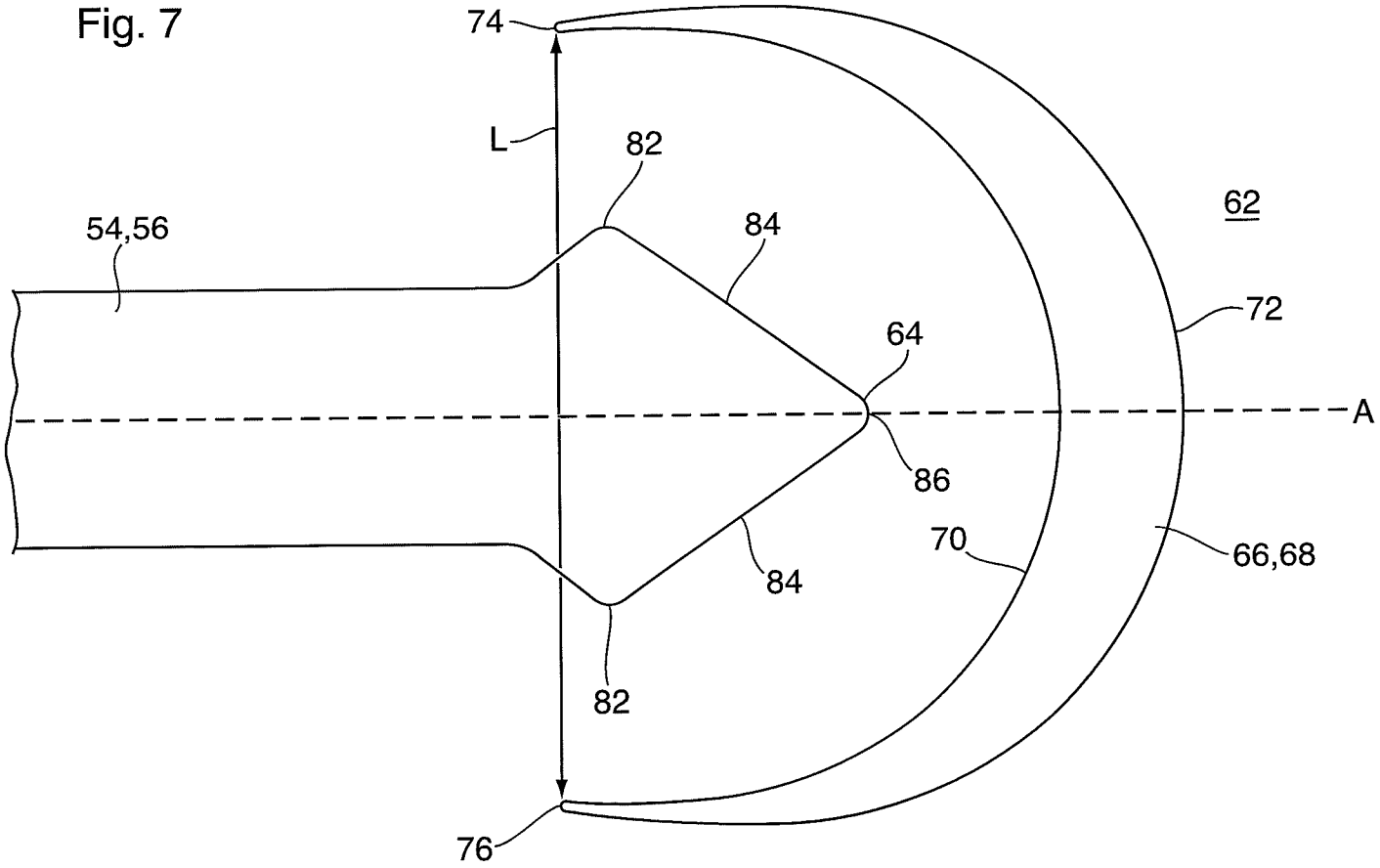
FIG. 7 is an enlarged plan view of the terminal end of a rib/flow barrier and a protrusion/flow obstruction of a core plate/plate pair according to another embodiment.

FIG. 7 is an enlarged plan view of a portion of a core plate/plate pair according to another embodiment, wherein FIG. 7 is similar to FIG. 1B in that it shows only the terminal end 64 of the rib 54/flow barrier 56 and the protrusion 68/flow obstruction 66 of the core plate/plate pair. Aside from the modifications to the elements illustrated in FIG. 7 and described below, the core plate/plate pair of FIG. 7 may be the same or similar to that shown in FIG. 1A.

In the embodiment of FIG. 7, the terminal end 64 of rib 54/flow barrier 56 has an arrowhead shape with small, generally angular side protrusions 82 extending transversely from the sides of ribs 54, the terminal end 64 further including inwardly directed sides 84 meeting at a rounded tip 86 of the terminal end 64. As in the embodiment of FIG. 6, the expansion of the terminal end 64 of the rib 54/flow barrier 56 permits the width of the remaining portions of the rib 54/flow barrier 56 to be narrower than that shown in FIGS. 1A and 1B. In this regard, the widest point of the rib 54/flow barrier 56 in FIG. 7 is at the side protrusions 82, and the width of the rib 54/flow barrier 56 at this point is substantially the same as the maximum width W of the rib 54/flow barrier 56 of FIG. 1B.

Figure 8:
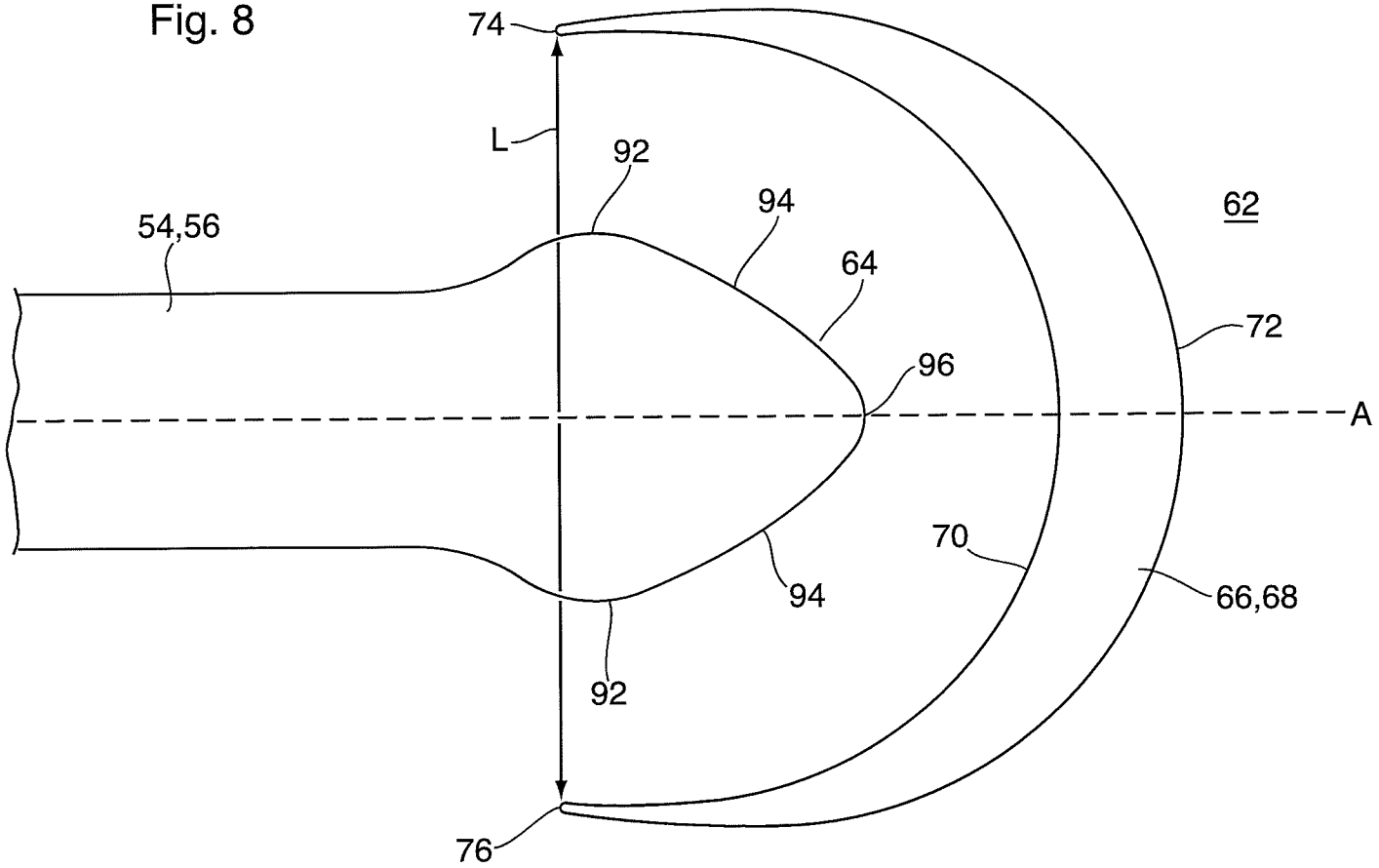
FIG. 8 is an enlarged plan view of the terminal end of a rib/flow barrier and a protrusion/flow obstruction of a core plate/plate pair according to another embodiment.

In the embodiment of FIG. 8, the terminal end 64 of rib 54/flow barrier 56 has a more rounded arrowhead shape with arcuately curved protrusions 92 extending transversely from the sides of rib 54/flow barrier 56 defining the widest point thereof, and with arcuately curved sides 94 extending inwardly from protrusions 92 toward a rounded tip 96.

Figure 9:
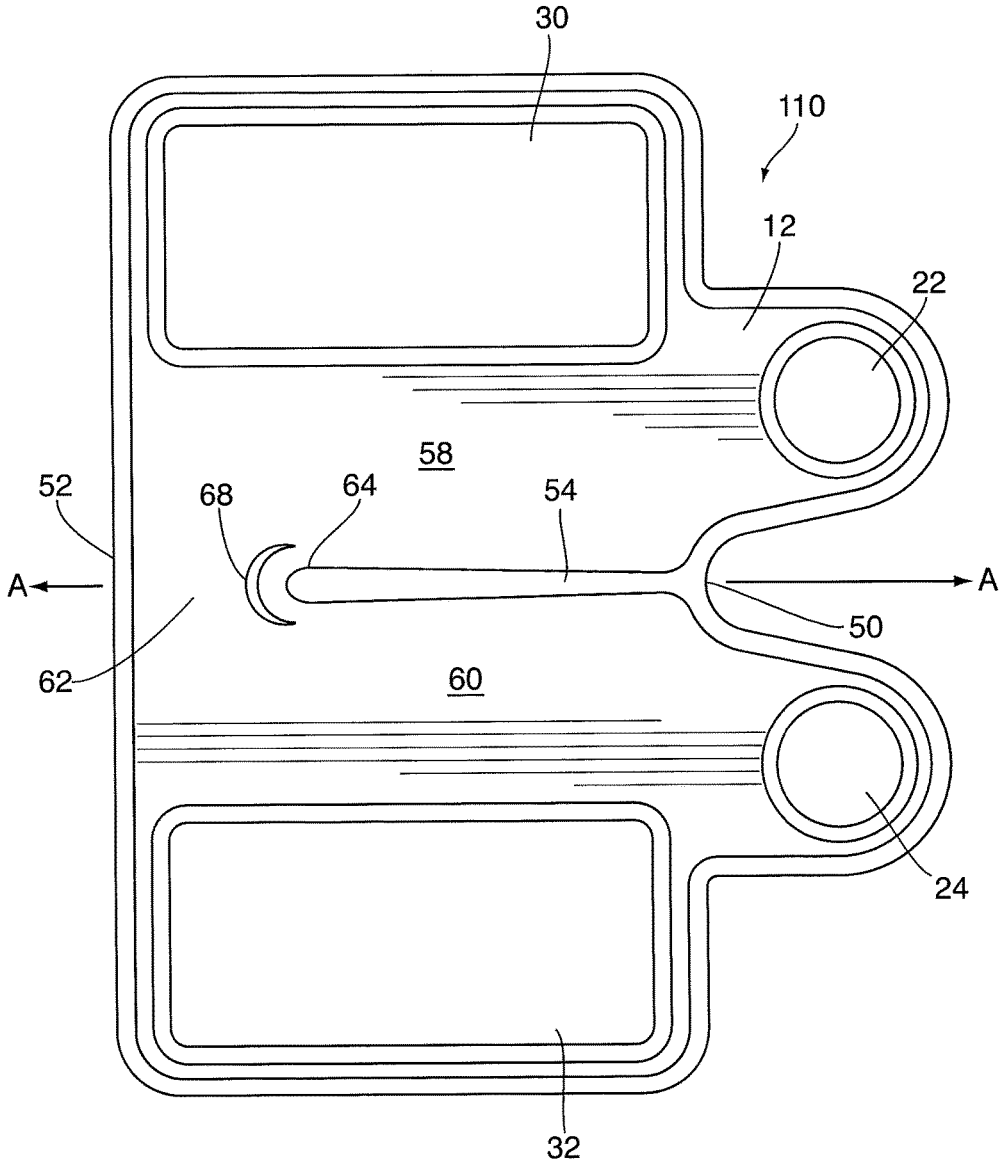
FIG. 9 is a plan view of a core plate according to another embodiment.

FIG. 9 illustrates a core plate 110 provided on its liquid side 12 with inlet and outlet openings 22, 24 for a first fluid, inlet and outlet openings 30, 32 for a second fluid, a longitudinally extending rib 54 extending from the first end 50 of core plate 110 to a terminal end 64 which is spaced from the second end 52 of core plate 110 by a gap 62.

In core plate 110, the rib 54 has a symmetrical wedge shape, wherein the straight sides of the rib 54 diverge gradually from one another from the first end 50 of plate 110 to the terminal end 64 of rib 54, the terminal end 64 being smoothly rounded. The shape of rib 54 in core plate 110 is advantageous in that it avoids an abrupt transition between the narrower part of rib 54 and the terminal end 64, it results in a rib 54 which may be wider than necessary along a portion of its length, reducing the heat transfer area of plate 110.

Figure 10:
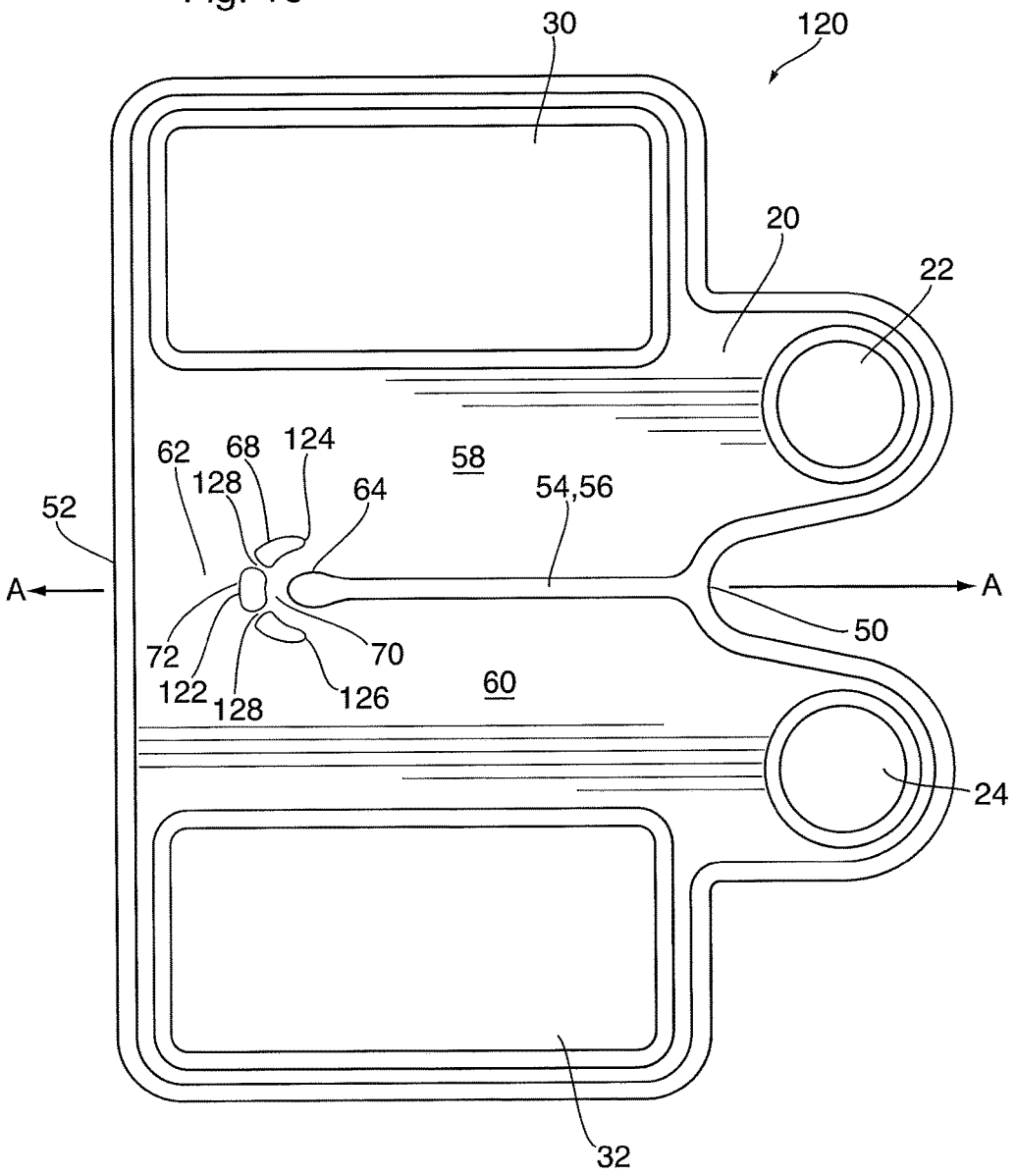
FIG. 10 is a plan view of a core plate according to another embodiment.

FIG. 10 illustrates a core plate 120 provided on its liquid side 12 with inlet and outlet openings 22, 24 for a first fluid, inlet and outlet openings 30, 32 for a second fluid, a longitudinally extending rib 54 extending from the first end 50 of core plate 120 to a terminal end 64 which is spaced from the second end 52 of core plate 120 by a gap 62.

Core plate 120 also includes a protrusion 68 with an overall crescent shape, comprised of a plurality of smaller protrusions, such as dimples 122, 124 and 126, which are spaced apart from one another, thereby forming a discontinuous protrusion 68 which will form a discontinuous flow obstruction. In this embodiment, there will be gaps 128 provided between adjacent dimples 122, 124, 126, these gaps 128 extending along the height of the flow obstruction 66 and the first fluid flow passage 20. A portion of the first fluid will flow through gaps 128 between the first side 70 and the second side 72 of the flow obstruction 66, helping to reduce flow separation along the second side 72 of the flow obstruction 66, as discussed below with reference to the embodiments shown in FIGS. 16 to 21.

All the dimples 122, 124, 126 may be of the same height, and may form part of the flat-topped sealing surfaces on the liquid side 12 of the core plate 10, as shown in FIG. 2. However, it will be appreciated that one or more of the dimples 122, 124, 126 may be reduced in height so as to introduce a gap between the opposed dimples 122, 124, 126 of opposed core plates 10 forming a plate pair 18. For example, the middle dimple 122 may be reduced in height relative to end dimples 124, 126 so as to permit some flow of fluid through the middle portion of the flow obstruction 66, through a gap between the dimples 122 of the opposed core plates 10. Alternatively, the end dimples 124, 126 may be reduced in height relative to the middle dimple 122 so as to permit some flow of fluid through the end portions of the flow obstruction 66, i.e. through a gap between the dimples 124 of the opposed core plates 10, and through a gap between the dimples 126 of the opposed core plates 10. In contrast to gaps 128, the gaps between opposed pairs of dimples 122, 124, 126 extend lengthwise and widthwise of the flow obstruction. The provision of these gaps extending lengthwise and widthwise of the flow obstruction 66 is further explained below with reference to FIGS. 16 to 21.

Figure 11:
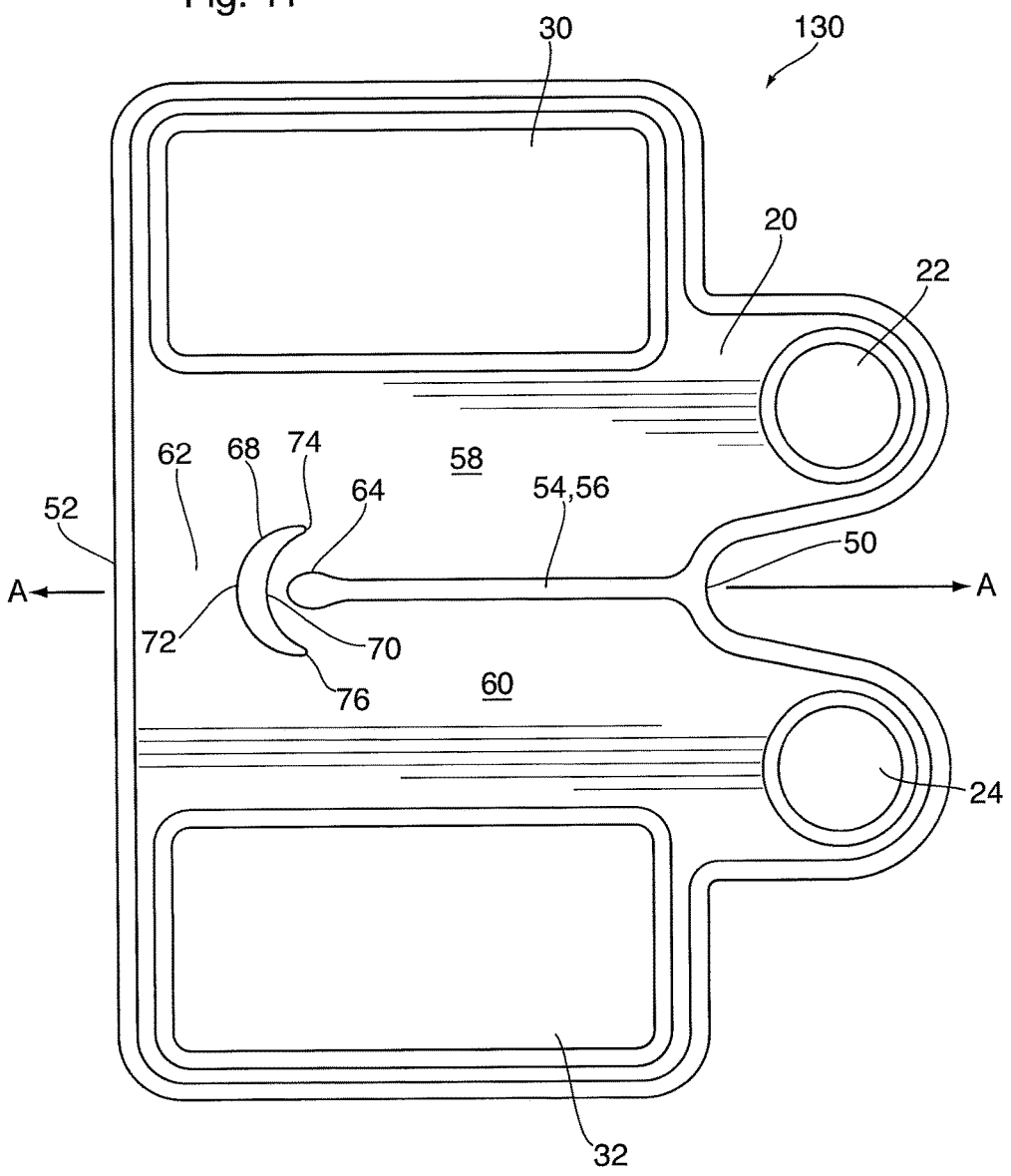
FIG. 11 is a plan view of a core plate according to another embodiment.

FIG. 11 illustrates a core plate 130 provided on its liquid side 12 with inlet and outlet openings 22, 24 for a first fluid, inlet and outlet openings 30, 32 for a second fluid, a longitudinally extending rib 54 extending from the first end 50 of core plate 130 to a terminal end 64 which is spaced from the second end 52 of core plate 130 by a gap 62.

Core plate 130 also includes a protrusion 68 in the form of a continuous crescent shape, similar to that of FIG. 6. However, the protrusion 68 of core plate 130 is somewhat flatter than that shown in FIG. 6, with the ends 74, 76 being more transversely spread out than those shown in FIG. 6, and with the curves of the first and second sides 70, 72 being flatter (i.e. with larger radii) than those shown in FIG. 1A. A protrusion 68 and corresponding flow obstruction 66 having the shape shown in FIG. 11 would be expected to provide a greater reduction in velocity than the protrusion 68/flow obstruction 66 of FIG. 1A, potentially reducing or eliminating any flow separation which may occur in the vicinities of second side 72 and end 76 of the protrusion 68/flow obstruction 66.

Although the embodiments described herein and shown in the drawings relate to U-flow heat exchangers in which the first fluid flowing through flow passages 20 changes direction once as it flows from the inlet opening 22 to the outlet opening 24. However, it will be appreciated that the heat exchangers within the scope of the present disclosure include those in which the fluid makes more than one change in direction, and such heat exchangers comprise core plates having two or more ribs 54 and two or more flow obstructions 66 as described herein.

Figure 12:
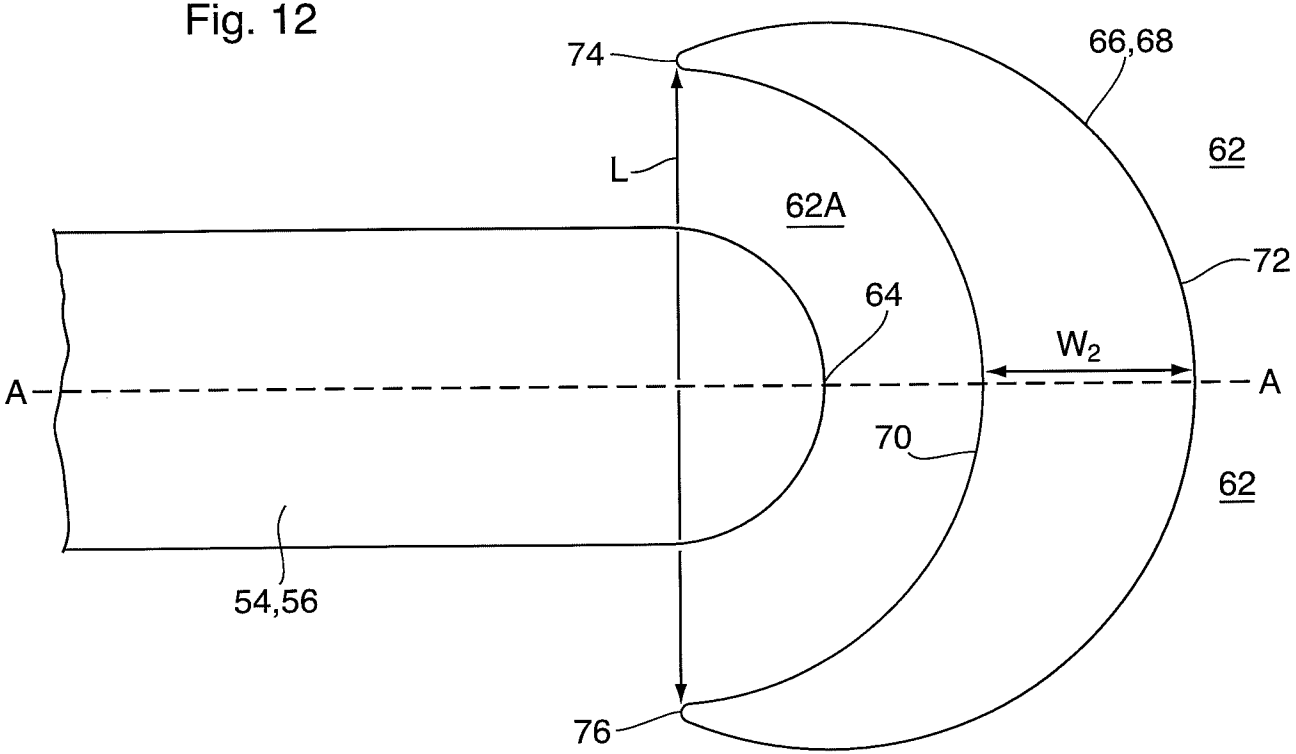
FIG. 12 is an enlarged plan view of the terminal end of a rib/flow barrier and a protrusion/flow obstruction of a core plate/plate pair according to another embodiment.

FIG. 12 is an enlarged plan view of a portion of a core plate/plate pair according to another embodiment, wherein FIG. 12 is similar to FIG. 1B in that it shows only the terminal end 64 of the rib 54/flow barrier 56 and the protrusion 68/flow obstruction 66 of the core plate/plate pair. Aside from the modifications to the elements illustrated in FIG. 12 and described below, the core plate/plate pair of FIG. 12 may be the same or similar to that shown in FIG. 1A.

The protrusion 68/flow obstruction 66 shown in FIG. 1B is relatively narrow, i.e. width dimension $W_2$ is relatively small. As shown in FIG. 12, the width of the protrusion 68/flow obstruction 66 may be increased so as to reduce flow separation around the second side 72 of the protrusion 68/flow obstruction 66. For example, as shown, the width W2 of protrusion 68/flow obstruction 66 of FIG. 12 along axis A is approximately twice that of the protrusion 68/flow obstruction 66 of FIG. 1B.

Figure 13:
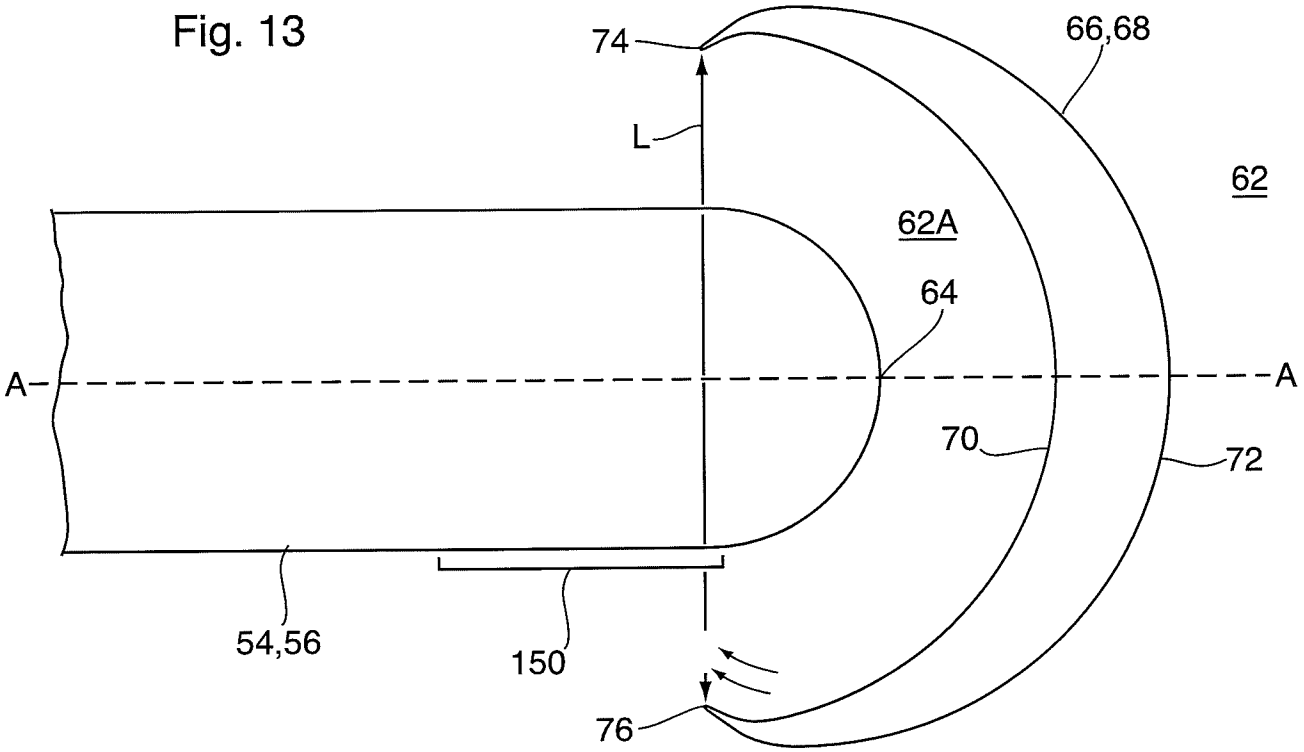
FIG. 13 is an enlarged plan view of the terminal end of a rib/flow barrier and a protrusion/flow obstruction of a core plate/plate pair according to another embodiment.
Figure 14:
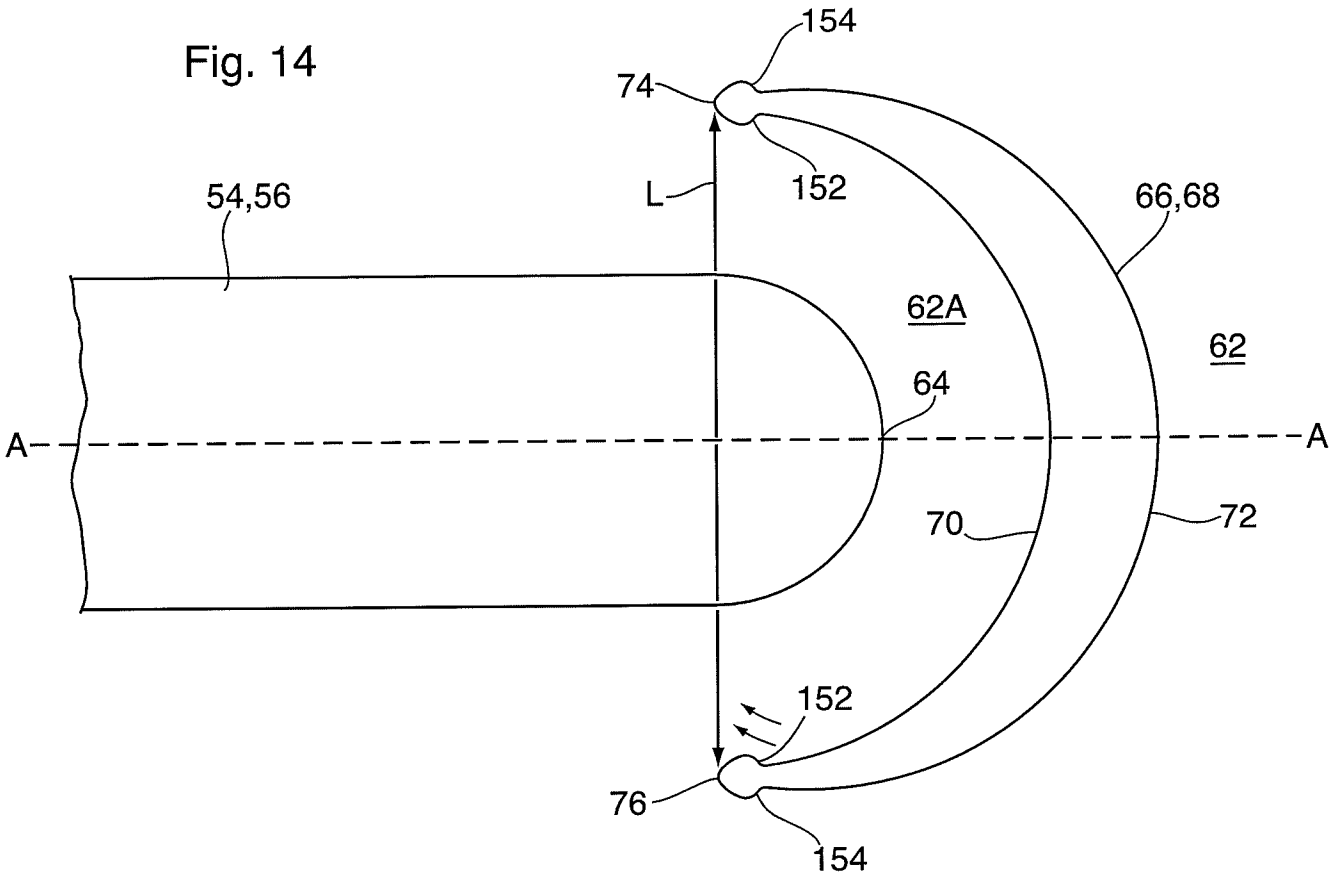
FIG. 14 is an enlarged plan view of the terminal end of a rib/flow barrier and a protrusion/flow obstruction of a core plate/plate pair according to another embodiment.
Figure 15:
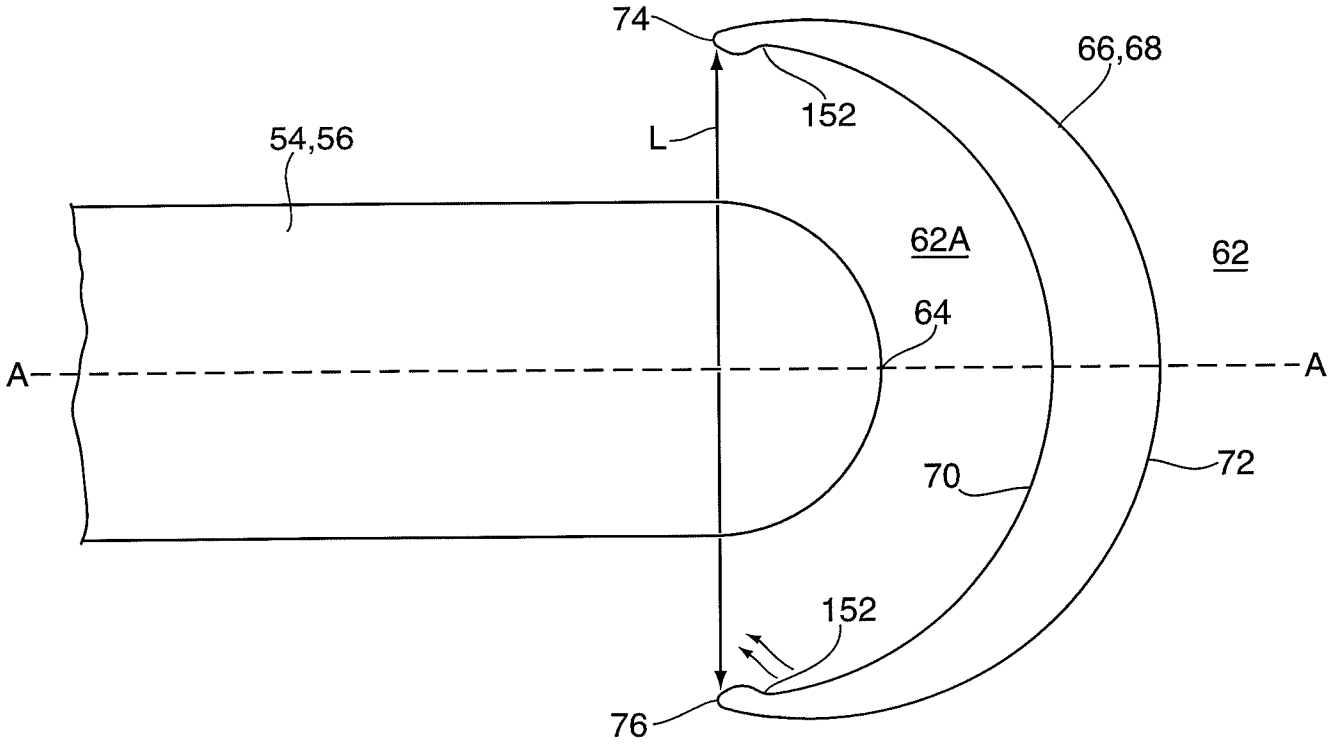
FIG. 15 is an enlarged plan view of the terminal end of a rib/flow barrier and a protrusion/flow obstruction of a core plate/plate pair according to another embodiment.

FIGS. 13 to 15 illustrate additional embodiments in which the ends 74, 76 of the protrusion 68/flow obstruction 66 are shaped so as to provide further reductions in flow separation, particularly in the portion of the flow which passes through the arcuate space 62A between the rib 54/flow barrier 56 and the protrusion 68/flow obstruction 66. FIGS. 13 to 15 each comprise an enlarged plan view similar to FIG. 1B, showing only the terminal end 64 of the rib 54/flow barrier 56 and the protrusion 68/flow obstruction 66 of the core plate/plate pair. Aside from the modifications to the elements illustrated in FIGS. 13 to 15, the core plate/plate pair illustrated in each of these drawings may be the same or similar to that shown in FIG. 1A.

The rib 54/flow barrier 56 and the protrusion 68/flow obstruction 66 of FIG. 13 are identical to those shown in FIG. 1B except that the ends 74, 76 of the protrusions 68/flow obstruction 66 are shaped so as to extend inwardly toward one another and toward the rib 54/flow barrier 56. The ends 74, 76 of protrusions 68/flow obstruction 66 are shown as being sharply pointed, however, it will be appreciated that they will be somewhat rounded.

The inwardly extending end 76 is located at the outlet of the arcuate space 62A, and directs the flow of the first fluid flowing through the arcuate space inwardly toward the sidewall of the rib 54/flow barrier 56 in the direction of the arrows adjacent to end 76 in FIG. 13. More specifically, the inwardly extending end 76 directs the flow of the first fluid toward an area of the rib 54/flow barrier 56 which is susceptible to flow separation and the formation of a dead zone/hot spot, this area being identified by reference numeral 150 in FIG. 13. Accordingly, the inwardly extending shape of the end 76 helps to reduce flow separation and thereby increase flow of the first fluid along the side of the rib 54/flow barrier 56 immediately downstream of the gap 62, i.e. downstream of the outlet of the arcuate space 62A.

Because the protrusions 68/rib 66 is symmetrical about axis A, both ends 74 and 76 are similarly shaped. However, only the inward extension of the end 76 at the outlet of the arcuate space 62A provides a beneficial reduction in flow separation. The inward extension of end 74 at the inlet of the arcuate space 62A may restrict flow of the first fluid into the space 62A where the inward extension of end 74 is too great. The amount of inward extension and the shape of the ends 74, 76 can be optimized, for example by computational fluid dynamics (CFD), so as to provide reduced flow separation at the outlet end of arcuate space 62A while avoiding flow restriction at the inlet end of arcuate space 62B.

FIG. 14 illustrates a rib 54/flow barrier 56 and protrusions 68/flow obstruction 66 identical to those shown in FIG. 1B except that the ends 74, 76 of the protrusions 68/flow obstruction 66 have a slightly bulbous shape, approximating a rounded arrowhead shape similar to that shown in FIG. 8. Thus, the first side 70 of the protrusions 68/flow obstruction 66 includes inwardly-extending surfaces identified by reference numeral 152 at which point the ends 74, 76 expand to form the bulbous shape. Similarly, the second side 72 of the protrusions 68/flow obstruction 66 include outwardly-extending surfaces 154 at this point. The ends 74, 76 are not necessarily expanded to form a rounded arrowhead, but may instead be expanded to any of the shapes described above with reference to FIGS. 6-8 and 10-11, or variations thereof. The bulbous shape of end 76, including inwardly-extending surface 152, provides a beneficial reduction in flow separation by directing the first fluid toward the rib 54/flow barrier 56 in the same manner as described above with reference to FIG. 13. In particular, the inwardly-extending surface 152 of the end 76 directs the flow of the first fluid inwardly toward rib 54/flow barrier 56 in the direction of the arrows shown in FIG. 14. The size and shape of the bulbous portion at ends 74, 76 can be optimized so as to provide reduced flow separation at the outlet end of arcuate space 62A while avoiding flow restriction at the inlet end of arcuate space 62B.

FIG. 15 illustrates a rib 54/flow barrier 56 and protrusions 68/flow obstruction 66 identical to those shown in FIG. 14 except that the ends 74, 76 of the protrusions 68/flow obstruction 66 are shaped such that only the first side 70 of rib 54/flow barrier 56 has a bulbous shape with inwardly-extending surface 152, while the second side 72 of rib 54/flow barrier 56 maintains its smooth, arcuate shape, and lacks the outwardly-extending surface 154 of the embodiment of FIG. 14. Thus, the embodiment of FIG. 15 provides inward direction of the first fluid toward rib 54/flow barrier 56 to reduce flow separation, while avoiding the potential creation of a wake zone downstream of the outwardly-extending surface 154 of the second side 72.

In addition, in the embodiment of FIG. 15, the inwardly-extending surface 152 at ends 74, 76 may be more smoothly shaped so as to avoid the creation of wake zones downstream of surfaces 152.

In each of the embodiments described above, the flow obstruction 66 is formed by a pair of crescent-shaped protrusions 68 extending upwardly from the base of the core plate 10 and having a height which is substantially the same as that of the core plate 10. When the plate pairs 18 are assembled with the liquid sides 12 of the core plates 10 in opposed facing relation to one another, the top surfaces of the protrusions 68 in the opposed core plates 10 are sealingly joined together, for example by brazing, to form the flow obstruction 66. The flow obstructions 66 in the above-described embodiments are free of perforations, such that all of the first fluid must flow around the flow obstruction 66.

It will be appreciated that the presence of the flow obstruction 66 within the first fluid flow passage may result in a certain amount of flow separation in the area "behind" the flow obstruction 66, i.e. along the second side 72 thereof. As a result of this flow separation, there may be a relatively small wake zone or dead zone along the second side 72.

The following description relates to embodiments shown in FIGS. 16-21, which include features to minimize flow separation and/or the formation of wake zones and dead zones along the second side 72 of the flow obstruction 66.

In some embodiments, this can be accomplished by permitting a minor amount of the first fluid to flow through the flow obstruction 66 from the first side 70 to the second side 72, thereby feeding additional fluid into the area along the second side 72, and reducing flow separation and/or the formation of wake zones and dead zones along the second side 72. In other embodiments, this can be accomplished by hollowing out the second side 72 of the flow obstruction 66, so as to encourage flow of the first fluid within the hollow portion of second side 72 and adjacent to second side 72. In other embodiments, a combination of these techniques may be used for reducing flow separation and/or the formation of wake zones and dead zones along the second side 72.

In order to more clearly explain the features of the flow obstructions 66 of the following embodiments, FIGS. 16-21 generally show the flow obstructions 66 in isolation. However, it will be appreciated that the flow obstructions 66 of FIGS. 16-21 may be incorporated into any of the core plates 10/plate pairs 18 described in connection with FIGS. 1-15. Conversely, any of the features of the flow obstructions 66 described in the following embodiments can be incorporated into the core plates 10/plate pairs 18 of the embodiments of FIGS. 1-15.

For the purpose of the following description, it will be assumed that the protrusions 68/flow obstructions 66 form part of a core plate 10/plate pair 18 which is identical in appearance to the core plate 10/plate pair 18 illustrated in FIGS. 1A to 5, except that the top surfaces of the protrusions 68 in the following embodiments do not necessarily form part of the sealing surface as shown in FIG. 2. Accordingly, any references to elements of the core plate 10/plate pair 18 in the following description should be understood as referring to FIGS. 1A to 5.

Figure 16:
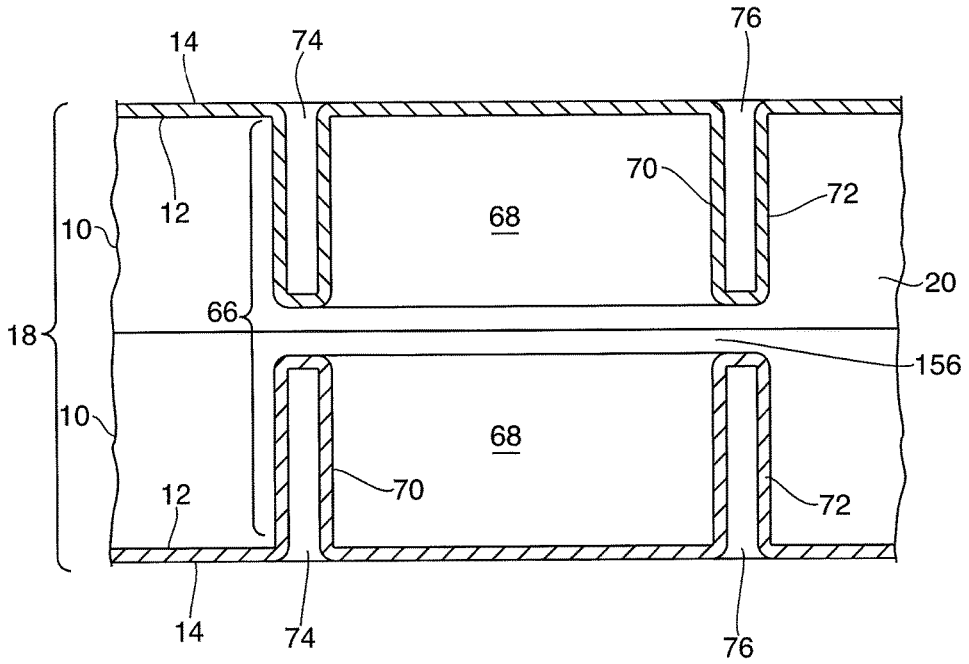
FIG. 16 is a cross-section through a plate pair along line 16-16' of FIG. 1B.
Figure 17:
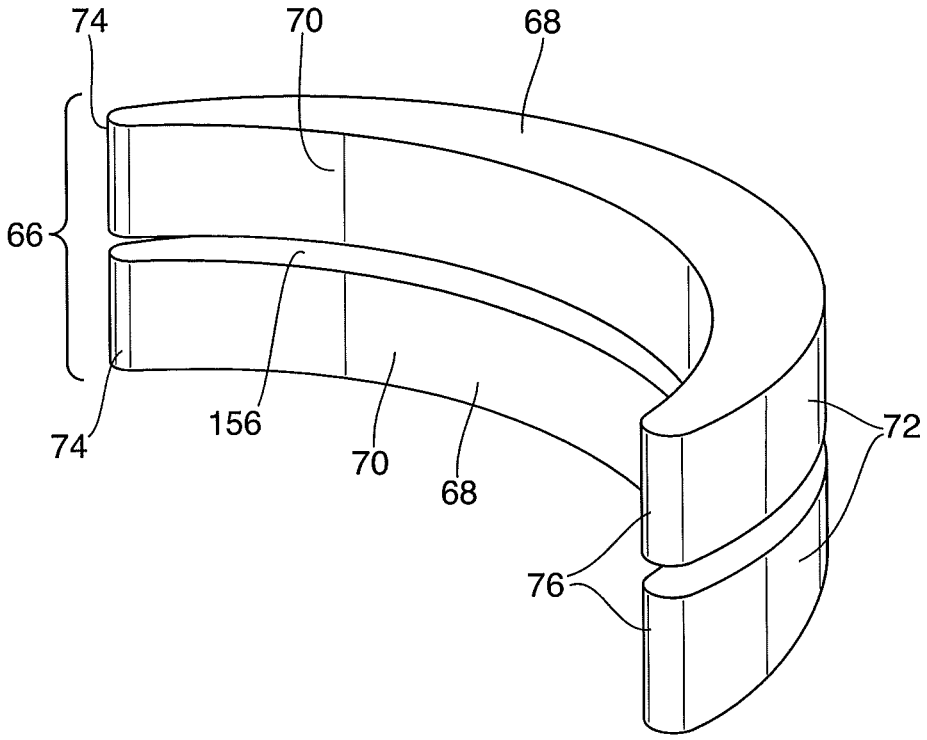
FIG. 17 is an isolated perspective view of a flow obstruction in accordance with FIG. 16.

In an embodiment illustrated in FIGS. 16 and 17, the height of the protrusions 68 is reduced so that they do not come into contact with one another when the plate pairs 18 are constructed from plates 10. This results in the formation of a gap 156 between the top surfaces of the protrusions 68 making up the flow obstruction 66, the gap 156 extending through the width of the flow obstruction 66 from the first side 70 to the second side 72, and permitting flow of the first fluid through the flow obstruction 66. Although FIG. 17 shows the protrusions 68/flow obstruction 66 as solid structures, it will be appreciated that they are hollow features formed by stamping of the core plate 10, as can be seen from the cross-section of FIG. 16, and from FIG. 3.

In the embodiment of FIGS. 16 and 17, the top surface of each protrusion 68 is flat and parallel to the base of the plate 10 from which it extends, and parallel to the flat-topped sealing surfaces on the liquid side 12 of the core plates 10. Therefore, the gap 156 in this embodiment is continuous and extends throughout the entire length and width of the flow obstruction 66. Furthermore, the gap 156 is of substantially constant height, wherein the height of gap 156 is defined as the distance between the top surfaces of the protrusions 68 making up the flow obstruction 66.

It will be appreciated that the height of gap 156 must be controlled, since the provision of an excessively large gap 156 in the flow obstruction 66 may result in increased flow separation in other areas of the first fluid flow passage 20, such as downstream of gap 62 along the side of flow barrier 56 located in the outlet portion 60 of the first fluid flow passage 20. The height of gap 156 is therefore controlled so that the positive effect of the gap 156 outweighs any negative effects, as may be determined by CFD analysis. The inventors have found that a gap 156 having a height which is no more than about 25 percent of the height of the first fluid flow passage 20 generally results in an overall positive effect, and also that an optimum height of gap 156 in at least some embodiments is no more than about 10 percent of the height of the first fluid flow passage 20.

In an embodiment illustrated in FIGS. 18 and 19, the gap 156 between the protrusions 68 extends only part way along the length of the flow obstruction 66. As shown, the top surfaces of the protrusions 68 are not flat, but rather are downwardly sloped from the ends 74, 76 toward the middle thereof. Thus, when the plate pairs are assembled, the flow obstruction 66 produced by these protrusions will have a gap 156 which is of minimum height adjacent the ends 74, 76 and maximum height at the middle, which will lie on the central longitudinal axis A. Although FIG. 18 shows the protrusions 68/flow obstruction 66 as solid structures, it will be appreciated that they are hollow features formed by stamping of the core plate 10, as can be seen from FIG. 3.

In addition, the top surfaces of protrusions 68 in the embodiment of FIGS. 18 and 19 slope downwardly from the first side 70 to the second side 72, thereby producing a gap 156 which increases in height from the first side 70 to the second side 72, i.e. in the axial dimension of the core plate 10/plate pair 18 as shown in the side view of FIG. 19. However, it will be appreciated that the gap 156 does not necessarily slope downwardly from first side 70 to second side 72, but rather may be parallel to the base of the plate 10 from which it extends, and parallel to the flat-topped sealing surfaces on the liquid side 12 of the core plates 10, such that the gap 156 will be of constant height between the first side and second side 72 of the flow obstruction 66.

In the embodiment of FIGS. 18 and 19, the top surfaces of the opposed protrusions 68 forming the flow obstruction 66 will be in contact in areas proximate to the ends 74, 76, and may be brazed together in these areas. However, it will be appreciated that the ends 74, 76 of the opposed protrusions 68 may be spaced apart, such that the gap 156 extends throughout the entire length of the flow obstruction 66, as in the embodiment shown in FIGS. 16 and 17.

Figure 20:
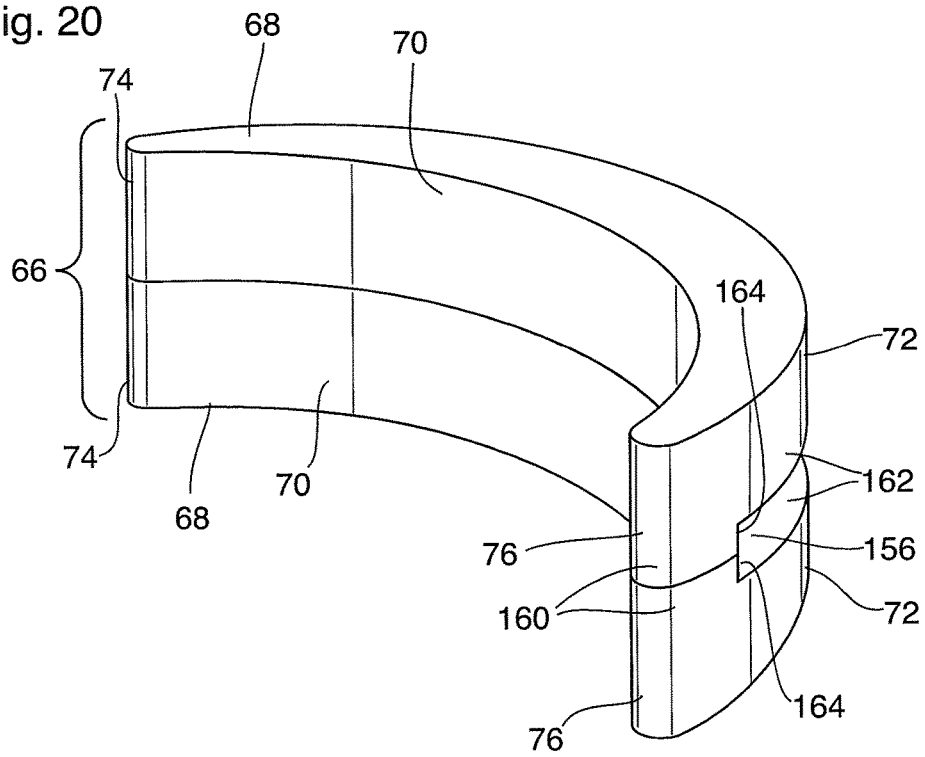
FIG. 20 is an isolated perspective view of a flow obstruction according to another embodiment.
Figure 21:
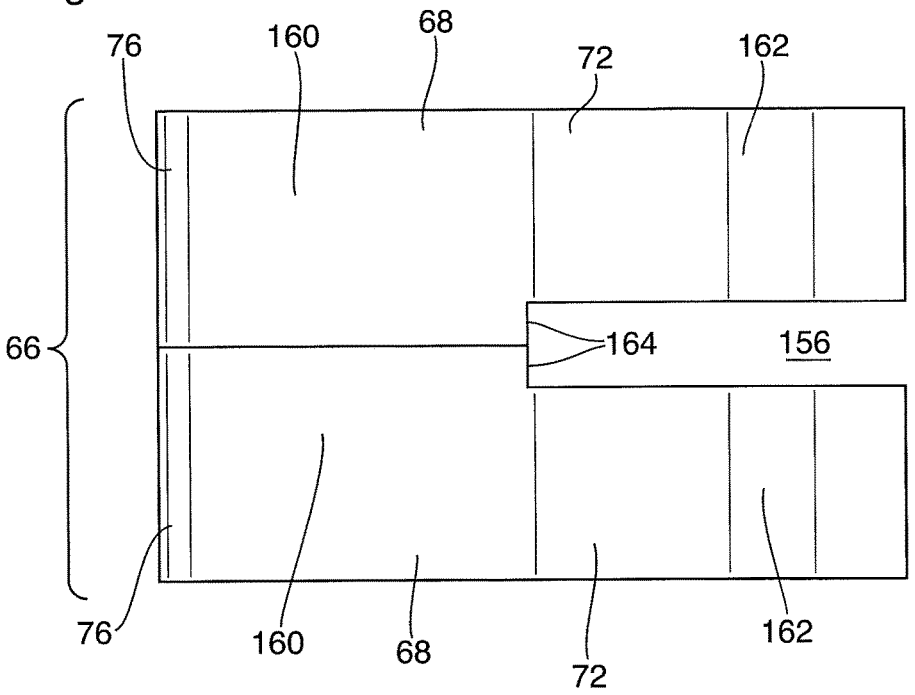
FIG. 21 is a side elevation of the flow obstruction of FIG. 20.

A flow obstruction 66 according to a further embodiment is illustrated in FIGS. 20 and 21. In this embodiment, the protrusions 68 making up the flow obstruction 66 have a "stepped" configuration, with a higher portion 160 proximate to the first side 70 and a lower portion 162 proximate to the second side 72, with the top surfaces of the higher and lower portions 160, 162 being separated by a shoulder 164. As shown, the shoulder 164 may be located such that the higher and lower portions 160, 162 have approximately the same width.

In the illustrated embodiment, the top surfaces of the higher and lower portions 160, 162 of each protrusion are both flat and parallel to the base of the plate 10 from which the protrusion 68 extends, and parallel to the flat-topped sealing surfaces on the liquid side 12 of the core plates 10. Alternatively, one or both of the higher and lower portions 160, 162 may be sloped along either the length or width of the protrusion 68 in the manner described above with reference to FIGS. 18 and 19.

Furthermore, in the embodiment shown in FIGS. 20 and 21, the top surface of the higher portion 160 of each protrusion 68 is co-planar with the flat-topped sealing surfaces on the liquid side 12 of the core plate 10, such that the top surface of the higher portion 160 of each protrusion 68 forms part of the sealing surface on the liquid side 12 of the core plate 10. Thus, when the plate pairs 18 are assembled, the top surfaces of the higher portions 160 of a pair of opposed protrusions 68 will be sealingly joined together, for example by brazing. The top surfaces of the lower portions 162 will, however, be spaced apart along the entire length of the flow obstruction 66, thereby providing a gap 156.

In contrast to the gaps 156 in the embodiments of FIGS. 16-19, the gap 156 in the embodiment of FIGS. 20-21 extends only partway through the width of the flow obstruction 66. More specifically, the gap 156 extends from the shoulder 164 to the second side 72 of the flow obstruction 66. There is no gap between the shoulder 164 and the first side 70 of the flow obstruction 66. Therefore, in the present embodiment, the second (back) side 72 of the flow obstruction is effectively hollowed out to permit fluid flow therethrough, while the flow of fluid through the width of the flow obstruction is prevented by the absence of any openings along the first side 70 thereof.

It will be appreciated that the embodiment of FIGS. 20-21 may be modified by reducing the height of the higher portions 160 so that they no longer form part of the sealing surface on the liquid side 12 of the core plate 10. This variant will be similar to that described in FIGS. 16 and 17, having a gap 156 extending throughout the entire length and width of the flow obstruction 66, however, the gap 156 will have a stepped configuration, being smaller between the higher portions 160 of the protrusions 68 and larger between the lower portions 162 of the protrusions.

The flow obstructions shown in any one of FIGS. 16-21 may further be divided into a plurality of segments, for example in the manner of the flow obstruction 66 shown in FIG. 10, comprising a plurality of dimples 122, 124, 126 separated by gaps 128 extending along the height of the flow obstruction 66, in addition to any gaps 156 extending lengthwise and widthwise of the flow obstruction 66.

Figure 22:
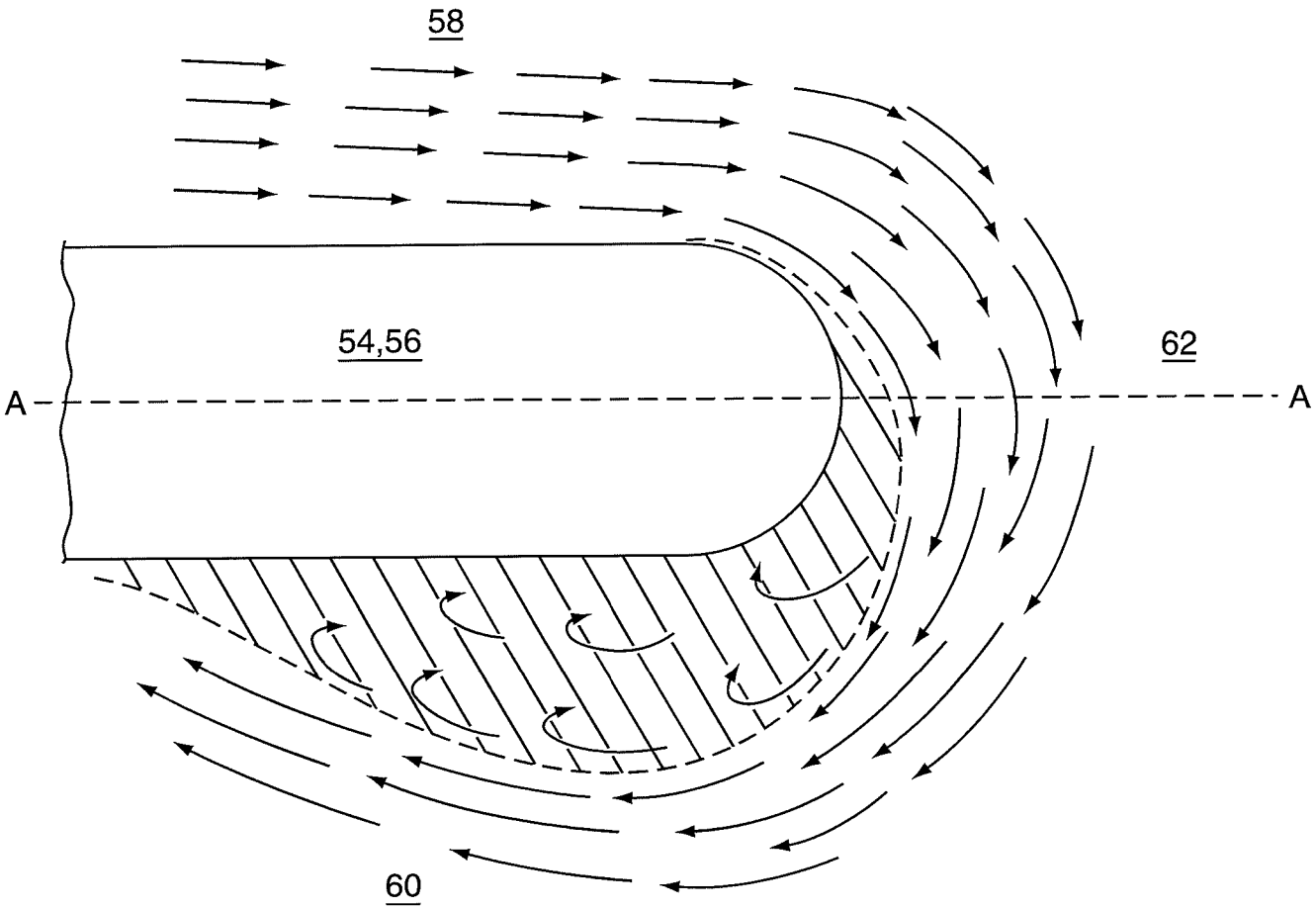
Fig. 22 ( Prior Art )
FIG. 22 shows the flow separation in a standard U-flow core plate plate with a central rib of small radius.
Figure 23:
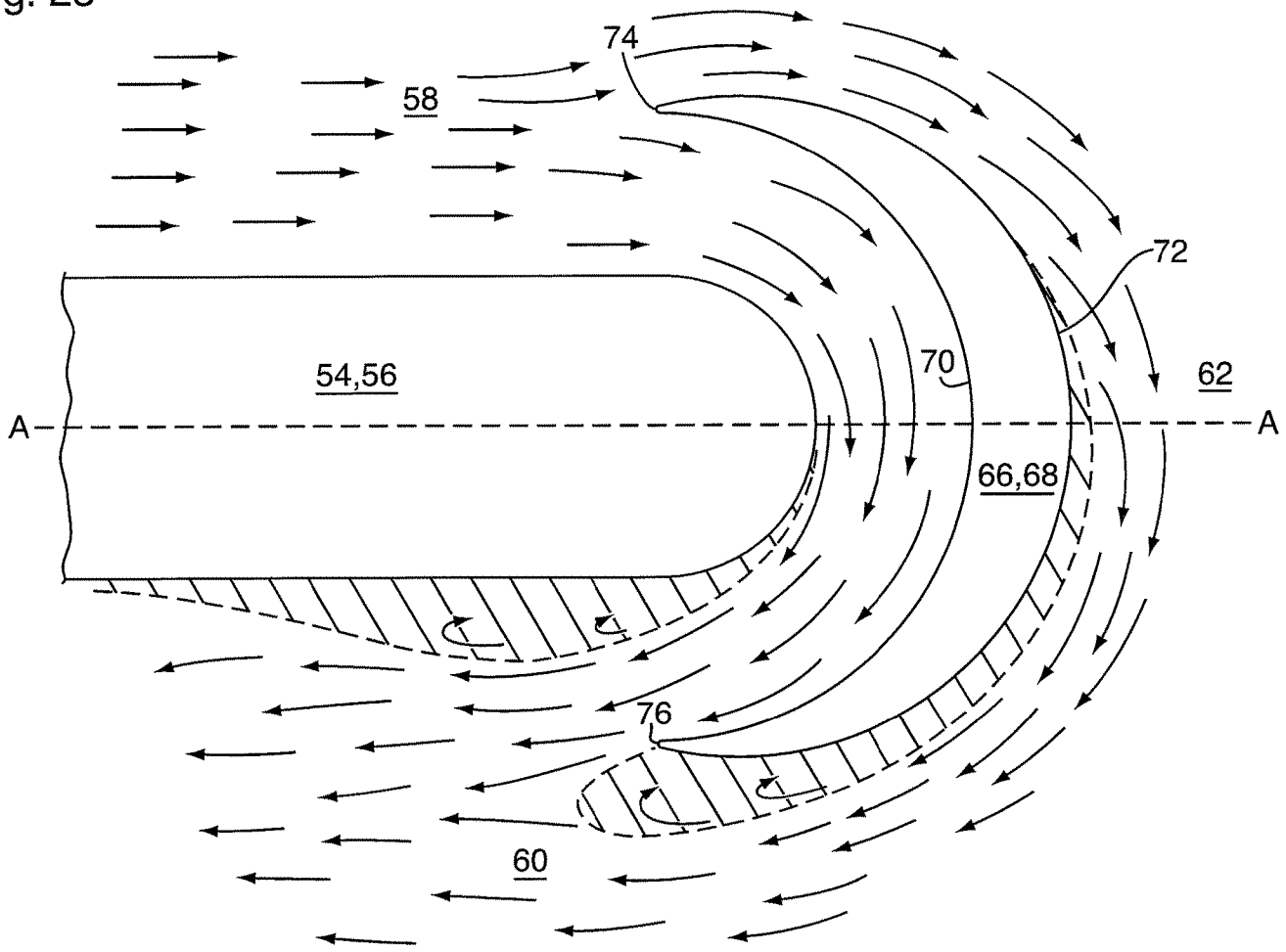
FIG. 23 shows the flow separation in a U-flow core plate having the configuration of FIG. 1B.

FIG. 23 roughly compares the area of flow separation in a core plate provided with the rib 54/flow barrier 56 and protrusion 68/flow obstruction 66 of FIG. 1B, showing that the area of flow separation along the downstream side of the rib 54/flow barrier 56, i.e. in the outlet portion 60, is smaller than in prior art FIG. 22. Furthermore, although there is some flow separation along the second side 72 of the protrusion 68/flow obstruction 66 in FIG. 23, there is an overall reduction in flow separation as compared with FIG. 22.

Although the invention has been described in connection with certain embodiments, it is not limited thereto. Rather, the invention includes all embodiments which may fall within the scope of the following claims.

What is claimed is:

1. A heat exchanger comprising at least one plate pair, wherein each plate pair of said at least one plate pair comprises:

(a) a first plate, a second plate, a first end and a second end;

(b) a fluid flow passage for flow of a first fluid defined between the first plate and the second plate;

(c) an inlet opening and an outlet opening, wherein the fluid flow passage extends between the inlet opening and the outlet opening, and wherein the inlet opening and the outlet opening are proximate to the first end;

(d) an elongate flow barrier separating the fluid flow passage into an inlet portion in which the inlet opening is located, and an outlet portion in which the outlet opening is located, wherein the flow barrier extends from the first end toward the second end, the flow barrier having a terminal end proximate to the second end and spaced from the second end by a gap through which fluid flow communication is provided between the inlet portion and the outlet portion of the fluid flow passage; and (e) a flow obstruction located in the gap, the flow obstruction having a middle portion, a pair of opposed ends, a first side and an opposed second side, wherein the first and second sides are arcuate, with the first side facing the terminal end of the flow barrier and spaced therefrom, wherein a central longitudinal axis of each of the first and second plates extends through the middle portion of the flow obstruction;

wherein the flow obstruction is crescent-shaped and the first and second sides of the flow obstruction meet at the opposed ends thereof;

wherein each of the first and second sides of the flow obstruction is smoothly and continuously rounded and describes a portion of a smoothly rounded shape, wherein the portion of the smoothly rounded shape described by the second side is larger than the portion of the smoothly rounded shape described by the first side;

wherein a width of the flow obstruction, as measured radially from a point along the central longitudinal axis, increases in a gradual manner from the opposed ends of the flow obstruction to the middle portion of the flow obstruction.

2. The heat exchanger of claim 1, wherein the first side of the flow obstruction approximates an arc of a first circle having a center which lies on the central longitudinal axis, and the second side of the flow obstruction approximates an arc of a second circle having a center which lies on the central longitudinal axis, the centers of the first and second circles being spaced apart along said axis, and the second circle having a larger radius than the first circle;

wherein said point along the central longitudinal axis is the center of the first circle or the center of the second circle.

3. The heat exchanger of claim 1, wherein the terminal end of the flow barrier is arc-shaped, and wherein an arcuate space of constant width is defined between the terminal end of the flow barrier and the first side of the flow obstruction, wherein the constant width is measured radially from a center of a semi-circle defining a curvature of the terminal end of the flow barrier.

4. The heat exchanger of claim 3, wherein a curvature of the first side of the flow obstruction deviates away from a circular arc proximate to the opposed ends, such that a width of the arcuate space proximate to the opposed ends is larger than a width of the arcuate space at the middle portion of the flow obstruction.

5. The heat exchanger of claim 4, wherein the flow barrier is straight and parallel to the central longitudinal axis extending between the first and second ends; and wherein the flow obstruction is symmetrical about the central longitudinal axis.

6. The heat exchanger of claim 5, wherein the flow obstruction has a transverse length between the opposed ends along a line which is perpendicular to the central longitudinal axis, and wherein a ratio of the transverse length to a maximum width of the flow barrier is at least 2:1.

7. The heat exchanger of claim 6, wherein the second side of the flow obstruction is shaped in portions thereof immediately adjacent to the opposed ends such that an included angle between the transverse line and each of said portions immediately adjacent to the opposed ends is in the range from about 60 degrees to about 120 degrees.

8. The heat exchanger of claim 1, wherein the opposed ends of the flow obstruction are shaped so as to extend inwardly toward one another and toward a sidewall of the flow barrier.

9. The heat exchanger of claim 8, wherein the opposed ends of the flow obstruction have a bulbous shape, wherein each of the bulbous shapes is partly defined by an inwardly-extending surface provided on the first side of the flow obstruction, and wherein each of the bulbous shapes is further partly defined by an outwardly-extending surface provided on the second side of the flow obstruction.

10. The heat exchanger of claim 9, wherein the opposed ends of the flow obstruction have a bulbous shape, wherein each of the bulbous shapes is partly defined by an inwardly-extending surface provided on the first side of the flow obstruction, and wherein each of the bulbous shapes is further partly defined by a smooth arcuate shape of the second side of the flow obstruction.

11. The heat exchanger of claim 1, wherein the flow obstruction is formed by a pair of crescent-shaped protrusions extending upwardly from a base of each of the first and second plates, each of the crescent-shaped protrusions having a top surface; and wherein each of the crescent-shaped protrusions has a height which is the same as a height of the first or second plate, and wherein the top surfaces of the crescent-shaped protrusions are sealingly joined together such that the flow obstruction is free of perforations.

12. The heat exchanger of claim 1, wherein the flow obstruction is formed by a pair of crescent-shaped protrusions extending upwardly from a base of each of the first and second plates, each of the crescent-shaped protrusions having a top surface;

wherein each of the crescent-shaped protrusions has a height which is less than a height of the first or second plate;

wherein the crescent-shaped protrusions have top surfaces which are spaced apart so as to provide a gap between the top surfaces of the crescent-shaped protrusions; and wherein the gap extends through the flow obstruction from the first side to the second side.

13. The heat exchanger of claim 12, wherein the top surface of each said crescent-shaped protrusion is flat and parallel to the base of the first or second plate from which it extends, such that the gap is continuous and extends throughout an entire length and width of the flow obstruction; and wherein the gap is of constant height.

14. The heat exchanger of claim 13, wherein the gap has a height which is no more than about 25 percent of a height of the fluid flow passage.

15. The heat exchanger of claim 12, wherein the top surface of each said crescent-shaped protrusion is flat and parallel to the base of the first or second plate from which it extends, such that the gap is continuous and extends throughout an entire length and width of the flow obstruction; and wherein the top surface of each said crescent-shaped protrusion is downwardly sloped from the opposed ends of the flow obstruction toward the middle portion thereof, such that the gap has a maximum height in the middle portion of the flow obstruction.

16. The heat exchanger of claim 12, wherein the top surface of each said crescent-shaped protrusion is flat and parallel to the base of the first or second plate from which it extends, such that the gap is continuous and extends throughout an entire length and width of the flow obstruction; and wherein the top surface of each said crescent-shaped protrusion is downwardly sloped from the first side to the second side of the flow obstruction, such that the gap increases in height from the first side to the second side.

17. The heat exchanger of claim 1, wherein the flow obstruction is formed by a pair of crescent-shaped protrusions extending upwardly from a base of each of the first and second plates, each of the crescent-shaped protrusions having a top surface; and wherein each said crescent-shaped protrusion has a stepped configuration, with a higher portion proximate to the first side of the flow obstruction and a lower portion proximate to the second side of the flow obstruction, wherein the higher and lower portions are separated by a shoulder.

18. The heat exchanger of claim 17, wherein the higher and lower portions of each said crescent-shaped protrusion have the same width; and/or wherein the higher portion of each said crescent-shaped protrusion has a height which is the same as a height of the first or second plate, and wherein the top surfaces along the higher portions of the crescent-shaped protrusions are sealingly joined together such that the flow obstruction is free of perforations along the first side thereof.

19. The heat exchanger of claim 17, wherein the top surfaces along the lower portions of the crescent-shaped protrusions are spaced apart from one another so as to provide a gap between the top surfaces along the lower portions of the crescent-shaped protrusions, wherein the gap extends from the shoulder to the second side of the flow obstruction.

20. The heat exchanger of claim 1, wherein the flow barrier has a width at the terminal end which is greater than a width of the flow barrier at the first end of the plate pair.

21. The heat exchanger of claim 1, wherein one or both of the flow barrier and the flow obstruction comprises a series of spaced apart ribs and/or dimples.

22. The heat exchanger of claim 20, wherein the flow barrier has an arrowhead shape with a small, generally angular side protrusions extending transversely from opposite sides of the flow barrier, and wherein the terminal end further includes inwardly directed sides meeting at a rounded tip of the terminal end.

23. The heat exchanger of claim 20, wherein the terminal end of the flow barrier has a rounded arrowhead shape with arcuately curved sides extending transversely from opposite sides of the flow barrier, and then extending inwardly toward a rounded tip.

* * * * *